US007575310B2

(12) United States Patent
Kobayashi

(10) Patent No.: US 7,575,310 B2
(45) Date of Patent: Aug. 18, 2009

(54) INK CARTRIDGE ATTACHMENT/DETACHMENT DEVICE, RECORDING APPARATUS, AND LIQUID EJECTION APPARATUS

(75) Inventor: Satoshi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 395 days.

(21) Appl. No.: 11/389,724

(22) Filed: Mar. 27, 2006

(65) Prior Publication Data

US 2006/0227166 A1 Oct. 12, 2006

(30) Foreign Application Priority Data

Mar. 28, 2005 (JP) ..... P2005-091547

(51) Int. Cl.
*B41J 2/175* (2006.01)

(52) U.S. Cl. ..... 347/86; 347/85

(58) Field of Classification Search ..... 347/37, 347/85–86

See application file for complete search history.

(56) References Cited

U.S. PATENT DOCUMENTS

2002/0118263 A1* 8/2002 Watanabe et al. ..... 347/86
2004/0119799 A1 6/2004 Kulpa et al.
2005/0001888 A1 1/2005 Seino et al.
2005/0168545 A1* 8/2005 Sakai et al. ..... 347/86

FOREIGN PATENT DOCUMENTS

EP 0 863 017 A2 9/1998
EP 0 872 355 A2 10/1998
EP 1547785 A2 6/2005
JP 11-157094 A 6/1999
JP 2002-240260 A 8/2002

OTHER PUBLICATIONS

Search Report for European Patent Appln. 06006385.6-2304 (Jul. 10, 2006).

* cited by examiner

*Primary Examiner*—Julian D Huffman
*Assistant Examiner*—Jason S Uhlenhake
(74) *Attorney, Agent, or Firm*—Stroock & Stroock & Lavan LLP

(57) ABSTRACT

An ink cartridge attachment/detachment device (1) includes a cartridge holding mechanism (30) that holds an ink cartridge (11) upon insertion of the ink cartridge (11) by a first predetermined stroke, and a power transmitting and converting mechanism (32) that ensures pressing force required for loading the ink cartridge (11) by using rotation of a lever arm (163) and leverage principle, and converts the rotation of the lever arm (163) into movement of a second predetermined stroke (S) required for loading the ink cartridge (11) held by the cartridge holding mechanism (30). The power transmitting and converting mechanism (32) includes a first cam portion (172) for moving the cartridge holding mechanism (30) by the second predetermined stroke (S).

4 Claims, 19 Drawing Sheets

FIG. 19A
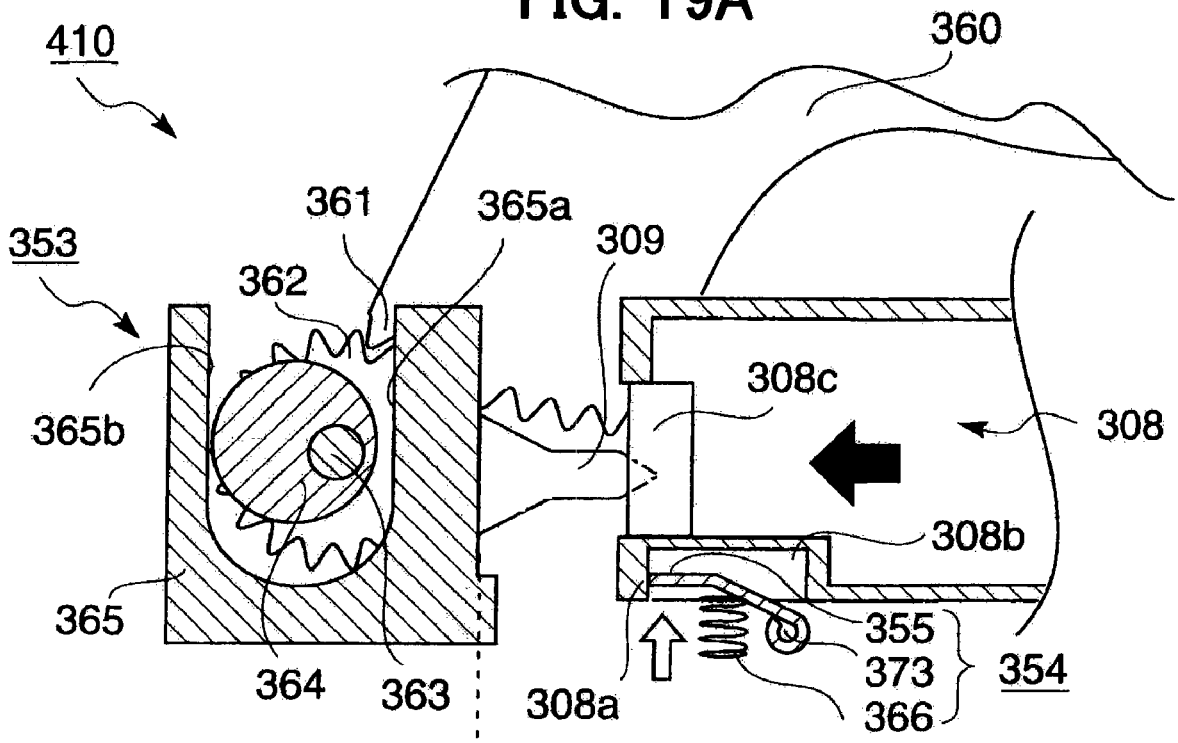
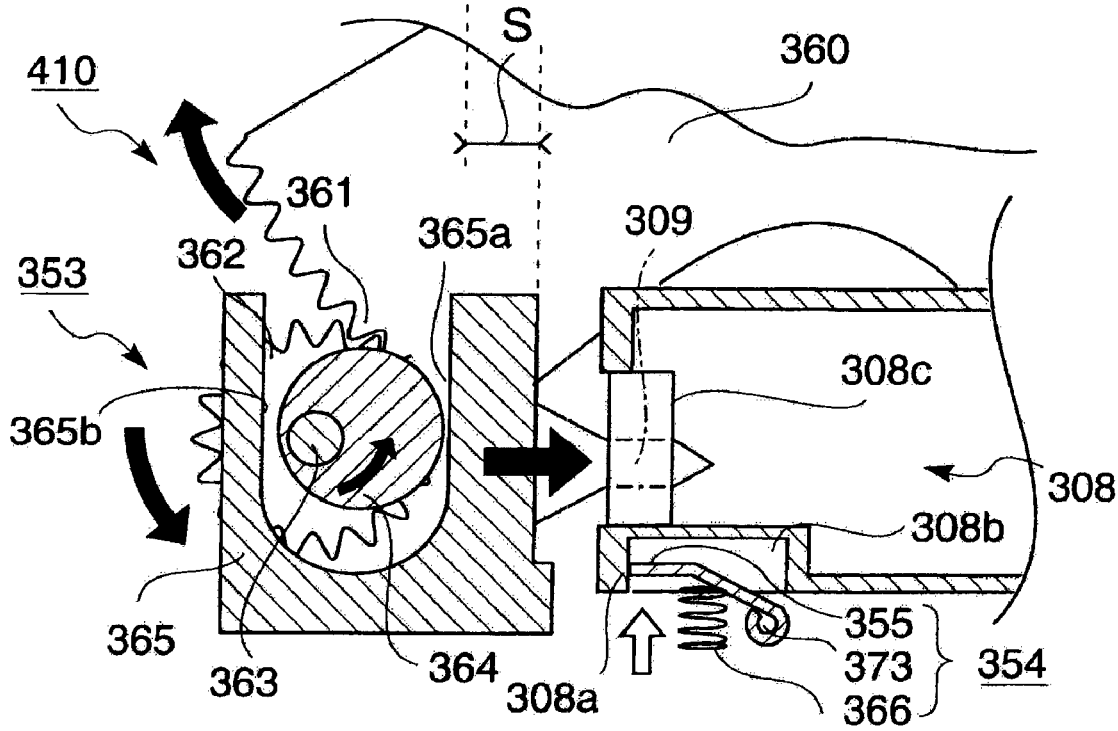
FIG. 19B

INK CARTRIDGE ATTACHMENT/DETACHMENT DEVICE, RECORDING APPARATUS, AND LIQUID EJECTION APPARATUS

BACKGROUND OF THE INVENTION

The present invention relates to an ink cartridge attachment/detachment device which loads an in cartridge into a main body of a recording apparatus by sliding the ink cartridge, to a recording apparatus having such an attachment/detachment device, and to a liquid ejection apparatus having such an attachment/detachment device.

Such a liquid ejection apparatus includes not only a recording apparatus, such as an ink jet recording apparatus, a copier, or a facsimile machine, that ejects ink from a recording head serving as a liquid ejection head to record images on a recording material, but also an apparatus which ejects a liquid corresponding to an intended purpose, instead of ink, from a liquid ejection head, which corresponds to the recording head, onto an ejected liquid target material, which corresponds to the recording material, to attach liquid to the ejected liquid target material. In addition to the recording head, the liquid ejection head can be a color material ejection head used for manufacturing a color filter for a liquid crystal display, an electrode material (conductive paste) ejection head used for forming an electrode for an organic EL display or a field emitting display (FED), a bio-organic ejection head used for manufacturing a bio-chip, or a sample ejection head which ejects a sample as a precision pipette.

A description will now be given for an ink jet printer as an example of an ink jet recording apparatus or a liquid ejection apparatus. A comparatively large pressing force is required to load an ink cartridge into an ink jet printer. When separate ink cartridges are provided for individual colors, the pressing force of about 4.9 to 6.9 N is sufficient. However, since a single package type ink cartridge with ink cartridges for a plurality of colors integrally formed includes a plurality of needles are provided, for example, in case of six colors, seven needles (for six colors and a waste ink tank) are provided, a very large pressing force of 34.3 to 48.3 N is required. Such a large pressing force can be exerted so long as; the ink cartridge is loaded vertically. However, when the ink cartridge is loaded by sliding the ink cartridge in a horizontal direction, an unnatural force is also imposed on the ink jet printer. Accordingly, the application of a large pressing force is practically impossible.

Disclosed in Patent Document 1 is an ink cartridge attachment/detachment device that uses leverage principle to obtain a large pressing force. According to this device, the rotation of a cartridge attachment/detachment lever is transmitted to a link plate to enable unlocking of a link lever and loading of an ink cartridge into a holder. However, this device is one developed for loading of ink cartridges for individual colors, and does not provide the large pressing force required to cope with a single package type ink cartridge with ink cartridges for a plurality of colors integrally formed. Further, if a cartridge attachment/detachment lever and a link plate are provided for each of the color ink cartridges, the number of parts may be increased, and the costs for parts may be higher.

Further, a cartridge which is being loaded or has been loaded is subjected to force for pushing the ink cartridge back from a flow path member connected to the ink cartridge. Therefore, in order to load the ink cartridge and maintain the loaded state, the pressing force should be greater than this force. Otherwise, a gap may appear between the ink cartridge and the flow path member, and contact points provided for the ink cartridge and the flow path member would be shifted, making it impossible to detect the residual amount of ink. Further, a position shift of the contact points may also occur due to a variation in size tolerances for the parts. However, Patent Document 1 does not disclose a configuration which provider such a large pressing force and maintains a close contact state.

Patent Document 1: JP-A-11-157094

SUMMARY OF THE INVENTION

The invention has been finalized in consideration of the above-described problems, and it is an object of the invention to provide an ink cartridge attachment/detachment device which, even though a single package type ink cartridge with a plurality of color ink cartridges integrally formed is used, can obtain a large pressing force with very little power to securely load the ink cartridge, to prevent position shift of the loaded ink cartridge, and to easily extract the ink cartridge, a recording apparatus having such an attachment/detachment device, and a liquid ejection apparatus having such an attachment/detachment device.

According to a first aspect of the invention, an ink cartridge attachment/detachment device, which loads an ink cartridge into a main body of a recording apparatus by sliding the ink cartridge, includes a cartridge holding mechanism that holds the ink cartridge upon insertion of the ink cartridge by a first predetermined stroke, and a power transmitting and converting mechanism that ensures pressing force required for loading the ink cartridge by using rotation of a lever arm and leverage principle, and converts the rotation of the lever arm into movement of a second predetermined stroke required for loading the ink cartridge held by the cartridge holding mechanism. The power transmitting and converting mechanism includes a first cam portion for moving the cartridge holding mechanism by the second predetermined stroke.

Here, 'insertion of ink cartridge' means that the ink cartridge is inserted into the recording apparatus from the outside and held by the cartridge holding mechanism. Further, 'loading of ink cartridge' means that the ink cartridge held by the cartridge holding mechanism is pushed together with the cartridge holding mechanism by the rotation of the lever and sticks in ink supply needles.

When gears directly push the cartridge holding mechanism, a variation in the second predetermined stroke may occur due to a variation in rotation angle of the gears caused by a tolerance of a gap between the gears occurring in a mechanism using gears, called a backlash.

According to the first aspect of the invention, the ink cartridge can be surely pushed by the second predetermined stroke because the power transmitting and converting mechanism includes the first cam portion for moving the cartridge holding mechanism by the second predetermined stroke. That is, when the cartridge holding mechanism is pushed by a cam mechanism, accurate positioning can be constantly performed.

In addition, the use of the lever arm having a comparatively long distance between an operation point and a fulcrum results in obtaining a comparatively large leverage ratio. Accordingly, the application of the leverage principle results in obtaining a large pressing force with very little power. Therefore, even a single package type ink cartridge can be easily loaded or extracted.

According to a second aspect of the invention, in the ink cartridge attachment/detachment device as cording to the first aspect, the power transmitting and converting mechanism may have a rack, pinion and cam mechanism.

According to the second aspect of the invention, in addition to the same advantages as those in the first aspect, a comparatively simple configuration can be used to convert the rotation of the lever arm into the movement of the cartridge holding mechanism or the ink cartridge held by the cartridge holding mechanism, the movement being the movement of the second predetermined stroke required for loading the ink cartridge. Further, the use of the rack results in increasing a transmission path or an operation length, and thus the number of parts can be reduced, as compared with a case where multiple gear trains are used to provide the transmission path.

According to a third aspect of the invention, in the ink cartridge attachment/detachment device according to the second aspect, the power transmitting and converting mechanism may include a first pinion that is attached to a base end of the lever arm to rotate together with the lever arm, a slide bar that has a first rack meshing with the first pinion and a second rack for transmitting movement of the first rack downstream along a transmission path, a second pinion that meshes with the second rack, a geared cam unit that has a gear meshing with the second pinion; together with the first cam portion for transmitting rotation of the gear downstream along the transmission path, and a first wall portion that is provided on the cartridge holding mechanism to be brought into contact with the first cam portion when the ink cartridge moves in a push-in direction.

According to the third aspect of the invention, in addition to the same advantages as those in the second aspect, last pressing of the ink cartridge is performed by the first cam portion because the first cam portion is provided lowermost stream (the most downstream) along the transmission path. Therefore, even though a backlash occurs in the pinion and the rack upstream along the transmission path, the second predetermined stroke can be uniformly maintained with high accuracy because the first cam portion is brought into direct contact with the first wall portion and pushes the cartridge holding mechanism by the second predetermined stroke. That is, the backlash upstream along the transmission path can be eliminated by the cam mechanism.

According to a fourth aspect of the invention, in the ink cartridge attachment/detachment device according to the third aspect, the power transmitting and converting mechanism may include a second wall portion that is provided on the cartridge holding mechanism to be brought into contact with the first cam portion when the ink cartridge moves in a push out direction.

According to the fourth aspect of the invention, in addition to the same advantages as those in the third aspect, the ink cartridge can be surely pushed by the second predetermined stroke because the power transmitting and converting mechanism includes the second wall portion which is brought into contact with the first cam portion when the ink cartridge moves in the push out direction. Therefore, the ink supply needles can be securely pulled out from the ink cartridge.

According to a fifth aspect of the invention, in the ink cartridge attachment/detachment device according to the fourth aspect, the first cam portion may have an angular portion at a position where a distance from a rotation fulcrum of the first cam portion becomes maximum, and, when the ink cartridge is pushed out, the angular portion may be brought into contact with the second wall portion.

When the ink cartridge is pushed out, that is, the ink supply needles are pulled out from the ink cartridge, ink leakage may occur if the stuck state of the ink supply needles halfway is prolonged.

According to the fifth aspect of the invention, in addition to the same advantages as those in the fourth aspect, the first cam portion includes the angular portion at the position where the distance from the rotation fulcrum of the first cam portion becomes maximum, and the angular portion is brought into contact with the second wall portion when the ink cartridge is pushed out. That is, the use of the angular portion at the position where the distance from the rotation fulcrum of the first cam portion, called a leverage length, becomes maximum results in providing a change in travel speed of the second wall portion serving as an operating portion. Therefore, a speed when the ink cartridge is pushed out, in particular, a speed of the moment when the ink supply needles are pulled out from the ink cartridge can be made fast. As a result, time of the stuck state of the ink supply needles halfway can be shortened, and thus ink leakage due to the stuck state of the ink supply needles halfway can be reduced.

According to a sixth aspect of the invention, in the ink cartridge attachment/detachment device according to any one of the first to fifth aspects, the first cam portion may have a chord portion and an arc portion.

According to the sixth aspect of the invention, in addition to the same advantages as those in the first to fifth aspects, because the first cam portion has the chord portion and the arc portion, contact portions of the chord portion and the cartridge holding mechanism can be brought into face contact with the chord portion, thereby providing a stable position. That is, in case that the ink cartridge is pushed by the second predetermined stroke, even though force against the pressing force of the ink cartridge, that is, force for releasing the ink cartridge from the ink supply needles, is applied, the cartridge holding mechanism can continue to be stably located at a predetermined position where the ink cartridge is pushed by the second predetermined stroke, without rotating the first cam portion.

In addition, when the contact point of the first cam portion to the cartridge holding mechanism is switched from the arc portion to the chord portion, that is, as described above, the contact portion of the cartridge holding mechanism is brought into face contact with the chord portion, the cartridge holding mechanism is slightly pushed back from the maximum pushed position by the force for releasing the ink cartridge from the ink supply needles. That is, the force for releasing the ink cartridge from the ink supply needles can be reduced by the amount that the cartridge holding mechanism is slightly pushed back. As a result, force to be accumulated in the attachment/detachment device can be reduced, and thus members can be prevented from deforming under a high-temperature condition.

According to a seventh aspect of the invention, an ink cartridge attachment/detachment device, which loads an ink cartridge into a main body of a recording apparatus by sliding the ink cartridge, includes a cartridge holding mechanism that holds the ink cartridge upon insertion of the ink cartridge by a first predetermined stroke, and a power transmitting and converting mechanism that ensures pressing force required for loading the ink cartridge by using rotation of a lever arm and leverage principle, and converts the rotation of the lever arm into movement of a second predetermined stroke required for loading the ink cartridge held by the cartridge holding mechanism. The power transmitting and converting mechanism includes a second cam portion for moving a flow path unit having needles to be inserted into the ink cartridge by the second predetermined stroke.

According to the seventh aspect of the invention, the power transmitting and converting mechanism has the second cam portion for moving the flow path unit having the needles to be inserted into the ink cartridge by the second predetermined stroke. Therefore, the flow path unit having the needles can be securely pushed to the ink cartridge by the second predetermined stroke. That is, when the flow path unit having the needles is pushed by a cam mechanism, accurate positioning can be constantly performed.

According to an eighth aspect of the invention, a recording apparatus includes an ink cartridge attachment/detachment device according to any one of the first to seventh aspects, which loads an ink cartridge into a main body of the recording apparatus by sliding the ink cartridge.

According to the eighth aspect of the invention, the recording apparatus includes the attachment/detachment device according to any one of the first to seventh aspects. Therefore, the recording apparatus can obtain the same advantages as those in any one of the first to seventh aspects.

According to a ninth aspect of the invention, a liquid ejection apparatus includes a liquid cartridge attachment/detachment device which loads a liquid cartridge into a main body of the liquid ejection apparatus by sliding the liquid cartridge. The liquid ejection apparatus includes a cartridge holding mechanism which holds the liquid cartridge upon insertion of the liquid cartridge by a first predetermined stroke, and a power transmitting and converting mechanism which ensures pressing force required for loading the liquid cartridge by using rotation of a lever arm and leverage principle, and converts the rotation of the lever arm into movement of a second predetermined stroke required for loading the liquid cartridge held by the cartridge holding mechanism. The power transmitting and converting mechanism includes a first cam portion for moving the cartridge holding mechanism by the second predetermined stroke.

The present disclosure relates to the subject matter contained in Japanese patent application No. 2005-091547 (filed on Mar. 28, 2005), which is expressly incorporated herein by reference in its entirety.

BRIEF DESCRIPTION OF THE DRAWINGS

FIGS. 19A and 19B are enlarged side views of the attachment/detachment device according to another embodiment of the invention.

DESCRIPTION OF THE PREFERRED EMBODIMENT

Figure 1:
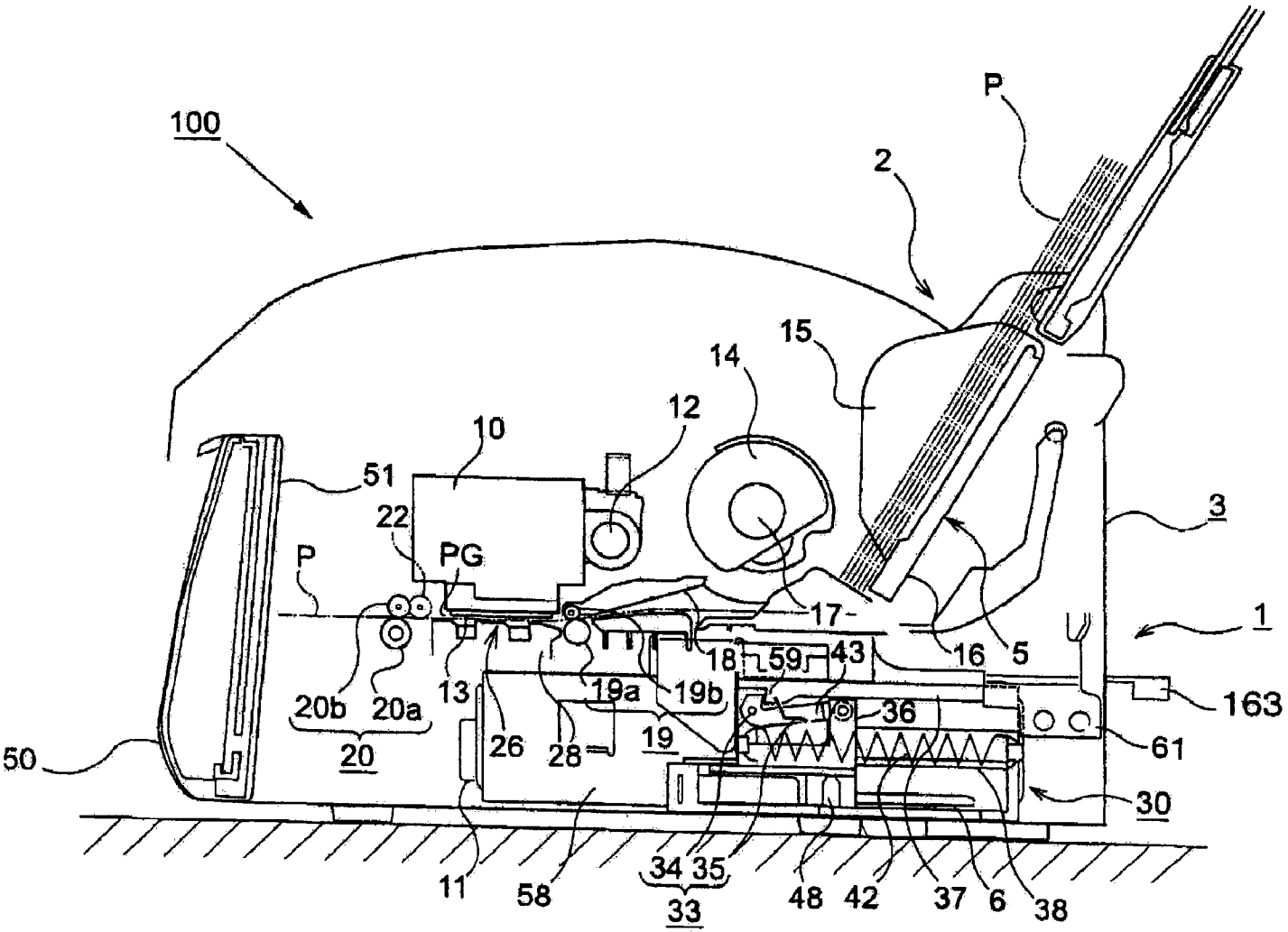
FIG. 1 is a side cross-sectional view showing the outline of an ink jet printer.

A description will now be given for an ink cartridge attachment/detachment device according to the invention and a recording apparatus which is an example of a liquid ejection apparatus having the attachment/detachment device. First, the outline of the overall configuration will be described with reference to the drawings by way of an ink jet printer which is used as the best mode for carrying out the recording apparatus. FIG. 1 is a side cross-sectional view showing the outline of an ink jet printer when an ink cartridge is loaded.

In an ink jet printer 100, a carriage 10 is supported by a carriage guide shaft 12 to reciprocate in a main scanning direction (a direction perpendicular to the paper in FIG. 1). The carriage 10 is the main part of a recording unit that is an example of a liquid ejection unit for recording a recording material P (hereinafter, simply referred to as sheet P) that is an example of a target material for liquid ejection. A recording head 13 is mounted on the carriage 10, and is an example of a liquid ejection head for discharging (ejecting) ink, which is an example of a liquid, to the sheet P. In a space of a main body 3 of the recording apparatus below the carriage 10, a single package type ink cartridge 11, which is an example of a liquid cartridge, is loaded through an ink cartridge attachment/detachment device 1 according to the invention described below.

A platen 28 is provided under and opposite to the recording head 13 to define a gap PG between the head face of the recording head 13 and the sheet P. Recording onto the sheet P or the like is performed by alternately and repetitively performing an operation for conveying the sheet P or the like between the carriage 10 and the platen 28 by a predetermined distance in a sub-scanning direction (a transverse direction in FIG. 1) perpendicular to the main scanning direction, and an operation for ejecting ink to the sheet P or the like from the recording head 13 while the recording head 13 reciprocates one time in the main scanning direction.

The configuration of the ink jet printer 100 will be further described based on a conveyance path of the sheet P. First, a feed tray 5, which is an example of a target material stacking portion for stacking the sheets P, is provided uppermost stream in a conveyance direction. An edge guide 15 is provided in the feed tray 5 to be brought into contact with side end faces of the sheets P and to smoothly guide the shoot P in the sub-scanning direction. As a rotational shaft 17 of a feed roller 14 rotates, a hopper 16 is lifted at a predetermined timing, and pushes up the sheet P on the feed tray S toward the feed roller 14.

A device including the feed tray 5, the feed roller 14, and the hopper 16 is an automatic sheet feeder 2. As the feed roller 14 rotates, a predetermined unit number of sheets P are sequentially picked up beginning from the uppermost sheet P by force exerted of a separation paid which is an example of a separation portion provided near the feed roller 14. The picked-up sheets P are conveyed downstream in the conveyance direction.

A recording material detector (not shown) (hereinafter, referred to simply as 'detection lever'), which is an example of a target material detection unit for detecting that the sheet P passes, is provided downstream the feed roller 14. Further, a conveyance roller 19, which includes a conveyance driving roller 19*a* and a conveyance driven roller 19*b*, is provided downstream the detection lever. Of these elements, the conveyance driven roller 19*b* is supported downstream a roller holder 18 for a conveyance driven roller. The roller holder 18 is provided to rotate on a rotational shaft (got shown) and is rotatably biased by a helical torsion coil spring (not shown), such that the conveyance driven roller 19*b* is constantly pressed into contact with the conveyance driving roller 19*a* to form a nip.

The sheet P, which is sandwiched and conveyed by the conveyance roller 19, is guided to a recording position 26 under the recording head 13, and desired recording is performed for substantially the entire recording face of the sheet P as the carriage 10 and the sheet P are moved in the above described manner. The gap PG, which is defined between the recording head 13 and the platen 28 provided under and opposite to the recording head 13, is an extremely important element for accurate recording, and is adjusted as needed in accordance with the thickness of the sheet P.

A discharge roller 20, which is an example of a target material discharge unit and includes a discharge driving roller 20*a* and a discharge toothed roller 20*b*, is provided downstream the recording head 13. The sheet P discharged by the discharge roller 20 is placed on a placing face 51 of a discharge stacker 50, which is an example of a target material accepting portion located downstream.

The discharge toothed roller 20*b* has a plurality of teeth along its outer edge, and is rotatably supported by a roller holder (not shown) for a discharge toothed roller. An auxiliary toothed roller 22 is provided upstream the discharge toothed roller 20*b*, and the sheet P is pushed slightly downward by the auxiliary toothed roller 22. The axis of the conveyance driven roller 19*b* is slightly downstream from that of the conveyance driving roller 19*a*. In addition, the axis of the discharge toothed roller 20*b* is slightly upstream from that of the discharge driving roller 20*a*.

With this configuration, between the conveyance roller 19 and the discharge roller 20, the sheet P is slightly bent and convex downwardly, that is, is set in a so-called 'reverse warped' state. Further, the sheet P located opposite to the recording head 13 is pressed against the platen 28 to prevent the lift of the sheet P, and proper recording is performed. Moreover, the auxiliary toothed roller 22 has a plurality of teeth, like the discharge toothed roller 20*b*, and is supported by a roller holder (not shown) for an auxiliary toothed roller.

The ink jet printer 100 according to this example is a printer that uses the single package type ink cartridge 11 with a plurality of color ink cartridges integrally formed, and that horizontally slides the ink cartridge 11 from a lower portion of the feed tray 5 at the back of the main body 3 of the recording apparatus to load the ink cartridge 11 therein.

A description will now be given for an ink cartridge attachment/detachment device according to the invention which is applied to the ink jet printer 100.

Figure 2:
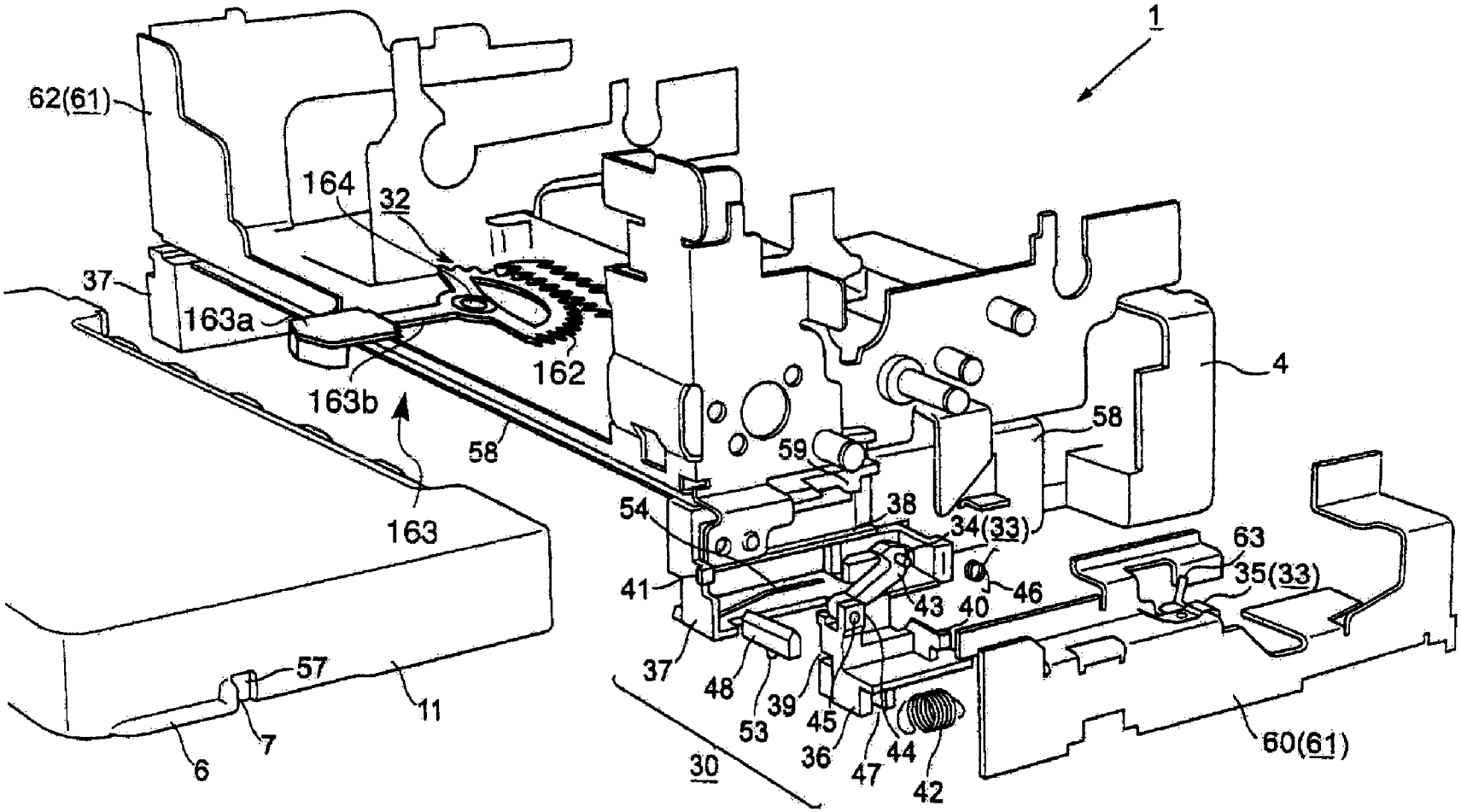
FIG. 2 is an exploded perspective view showing an attachment/detachment device before an ink cartridge is inserted.
Figure 3:
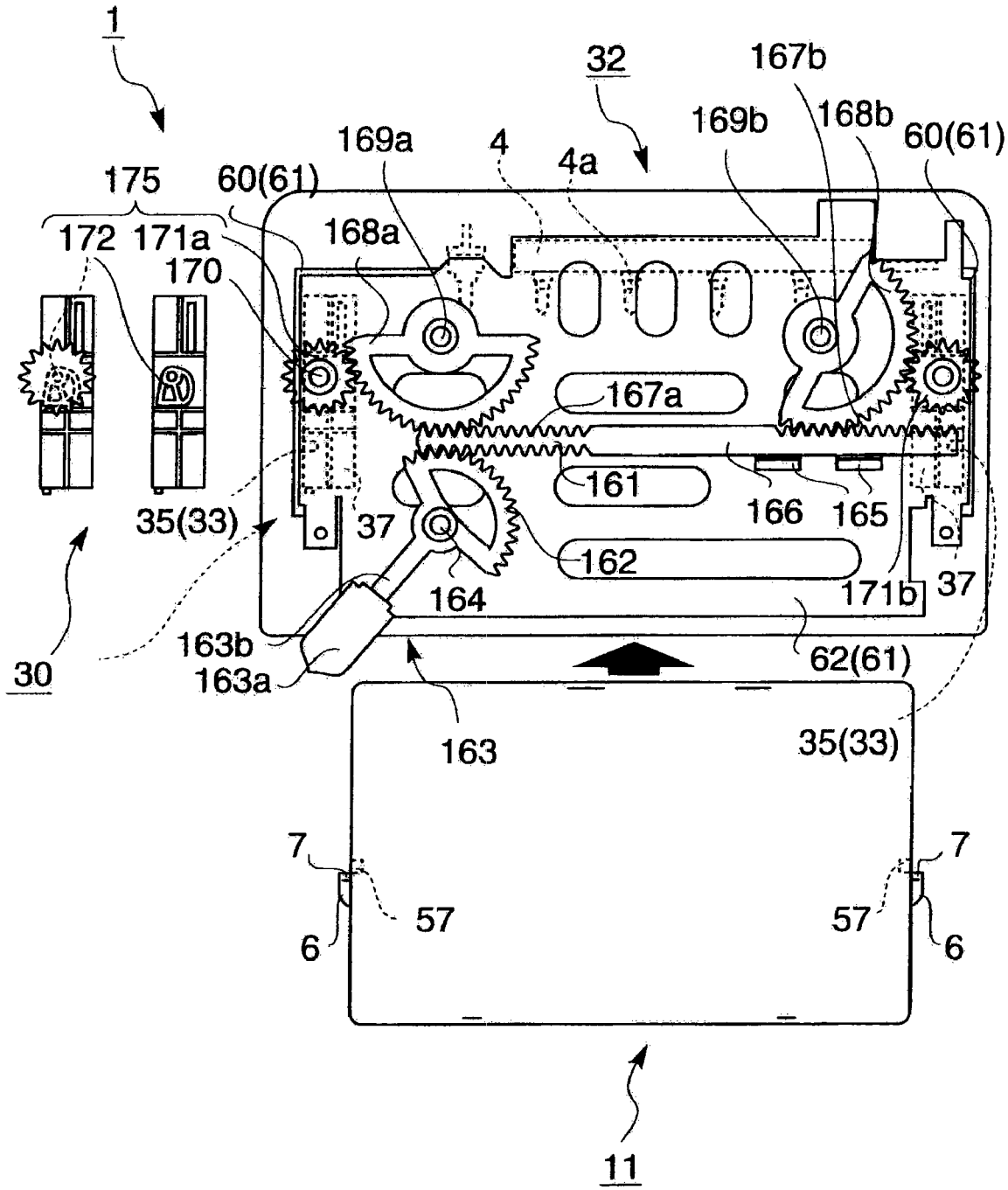
FIG. 3 is a plan view showing the attachment/detachment device before the ink cartridge is inserted.
Figure 4A:
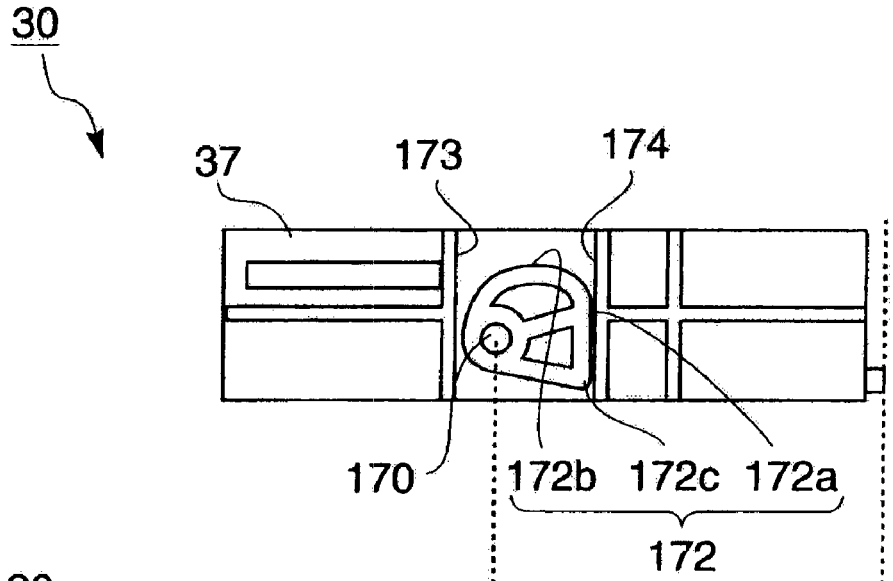
FIGS. 4A to 4C are plan views showing the operation of an eccentric cam portion when the ink cartridge is loaded.
Figure 4B:
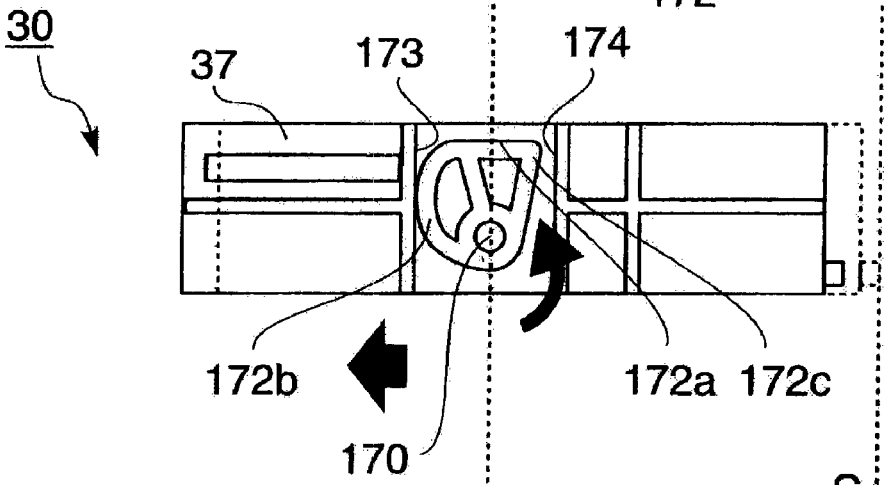
Figure 4C:
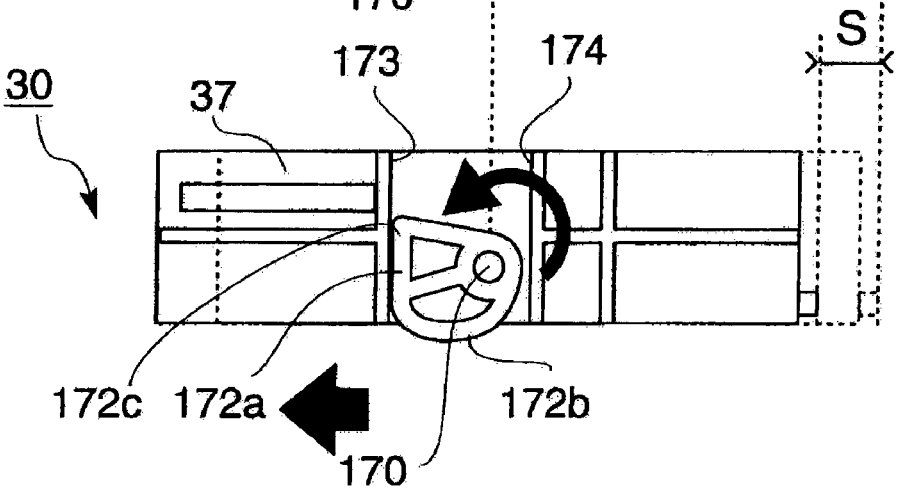
Figure 5:
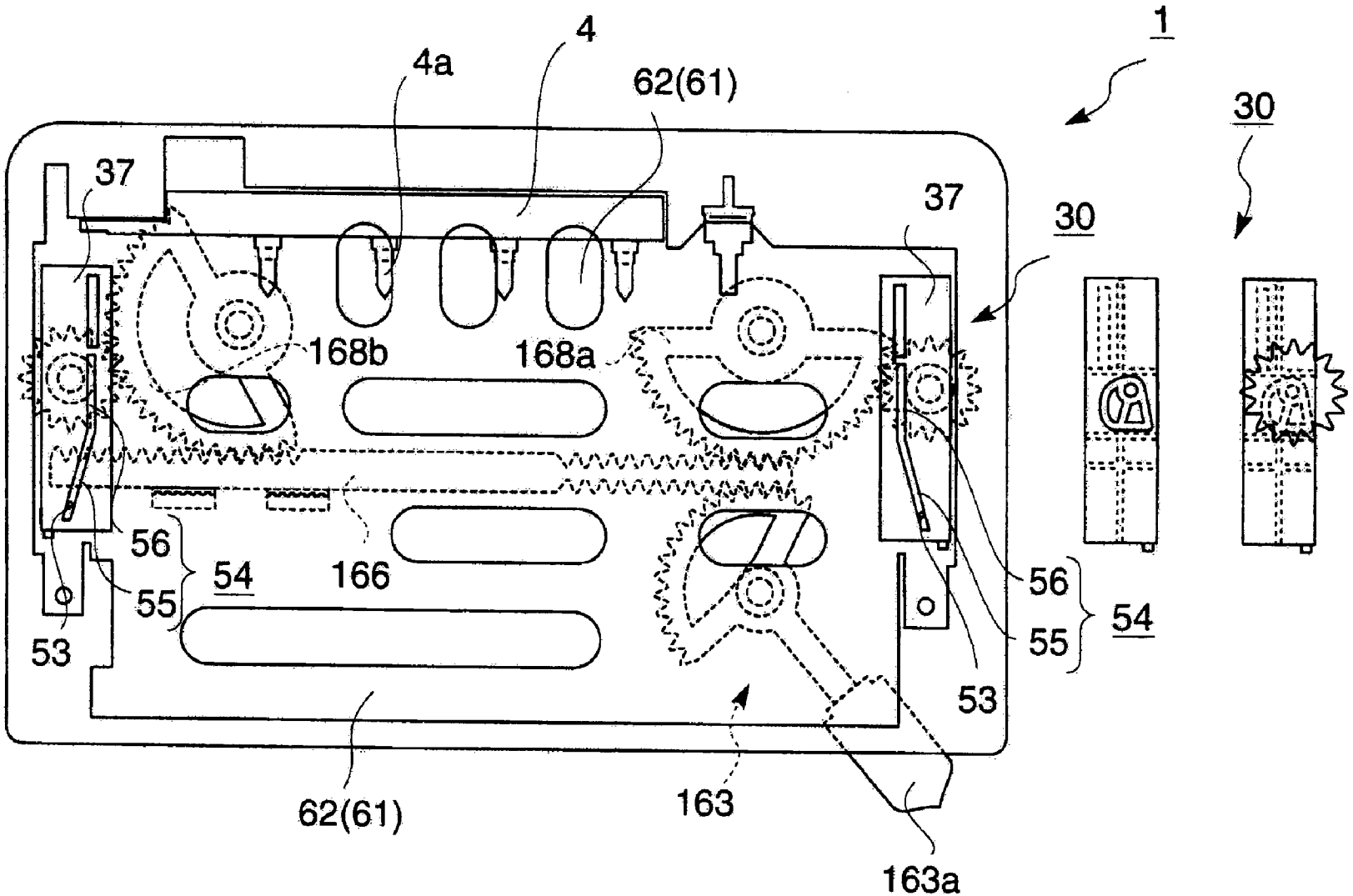
FIG. 5 is a bottom view showing the attachment/detachment device before the ink cartridge is inserted.
Figure 6:
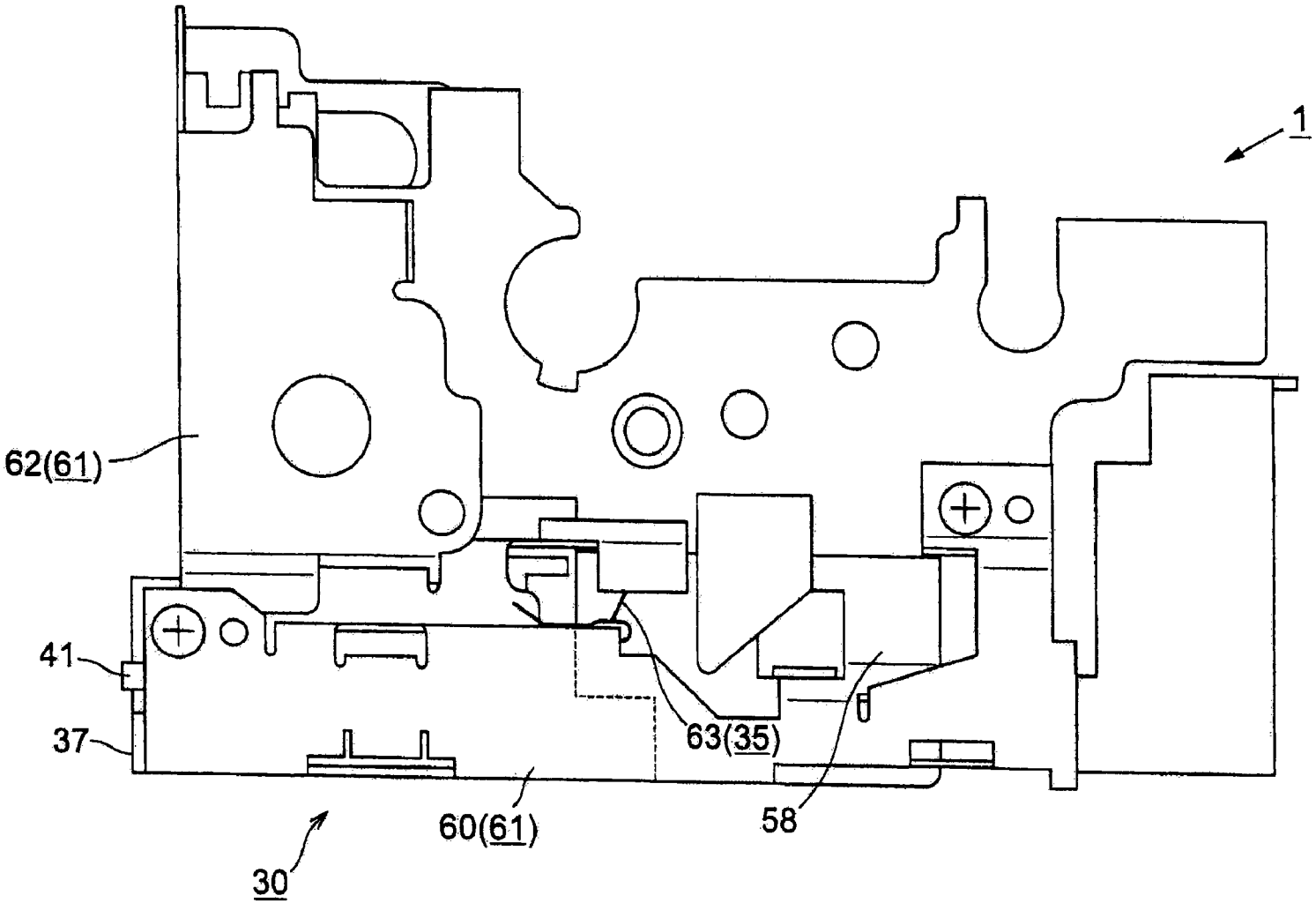
FIG. 6 is a side view showing a cartridge holding mechanism before the ink cartridge is inserted.
Figure 7:
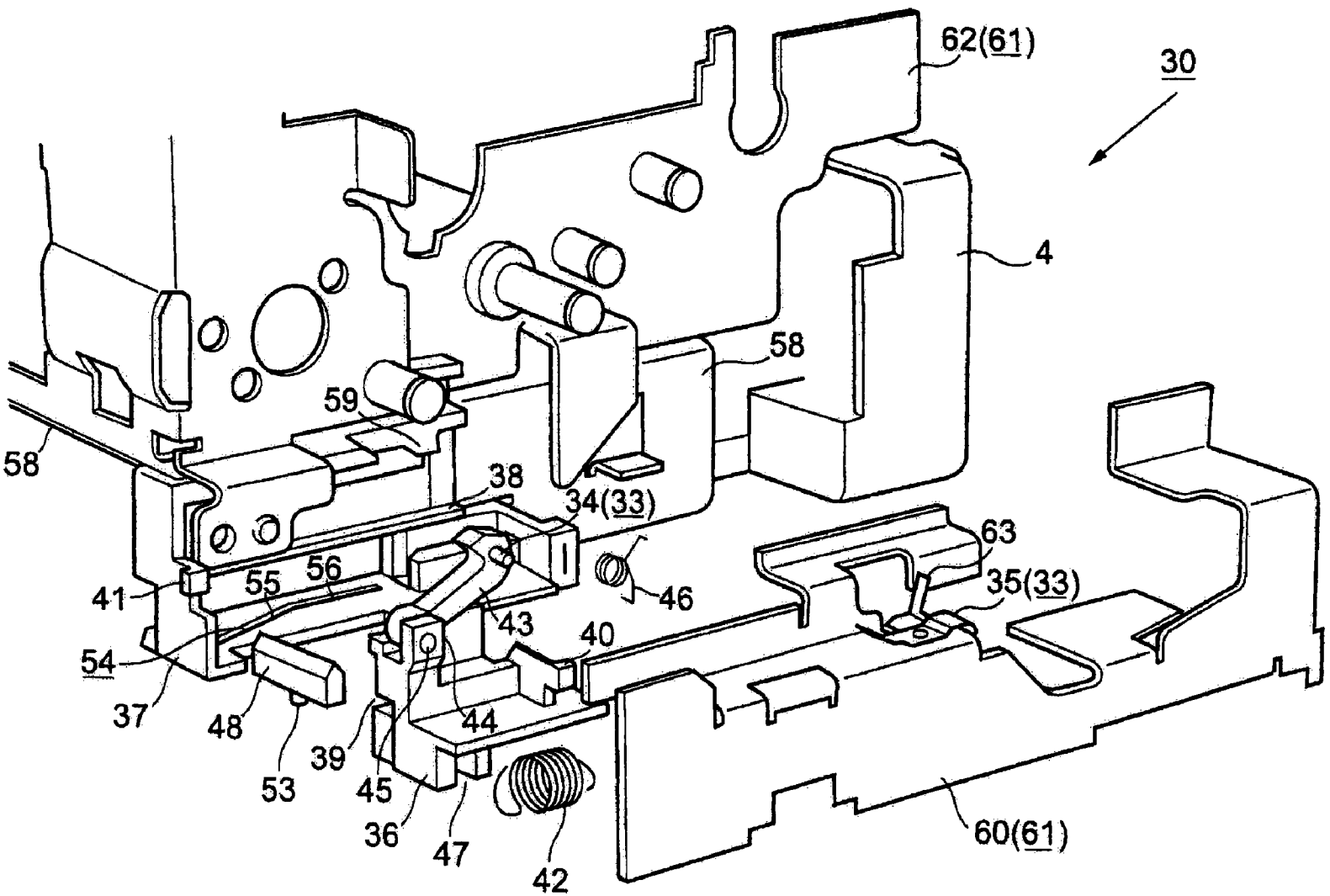
FIG. 7 is an exploded perspective view showing the cartridge holding mechanism on a magnified scale.

FIG. 2 is an exploded perspective view of the attachment/detachment device in a state before the ink cartridge is inserted. FIG. 3 is a plan view of this state. FIGS. 4A to 4C are plan views showing the operation of an eccentric cam portion 172 when the ink cartridge is loaded. FIG. 5 is a bottom view of the attachment/detachment device before the ink cartridge is inserted. FIG. 6 is a side view of a cartridge holding mechanism before the ink cartridge is inserted. FIG. 7 is an exploded perspective view of the cartridge holding mechanism on a magnified scale.

Figure 8A:
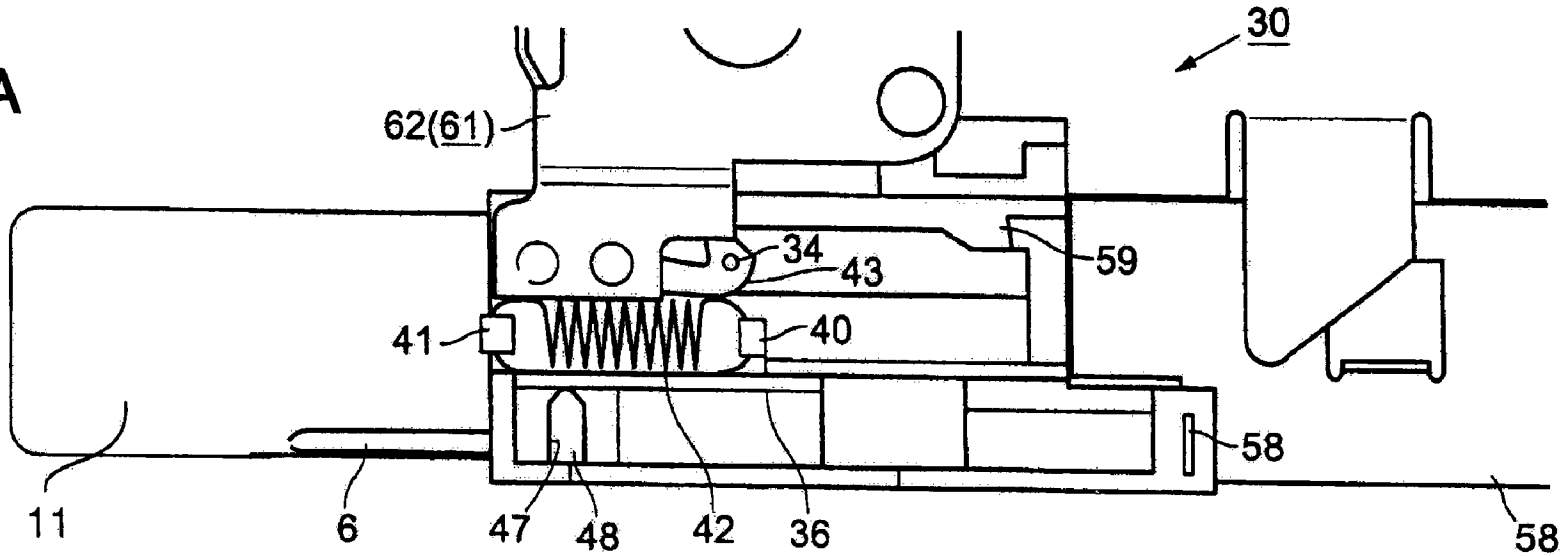
FIGS. 8A and 8B are a side view and a bottom view showing the cartridge holding mechanism before the ink cartridge is inserted.
Figure 8B:
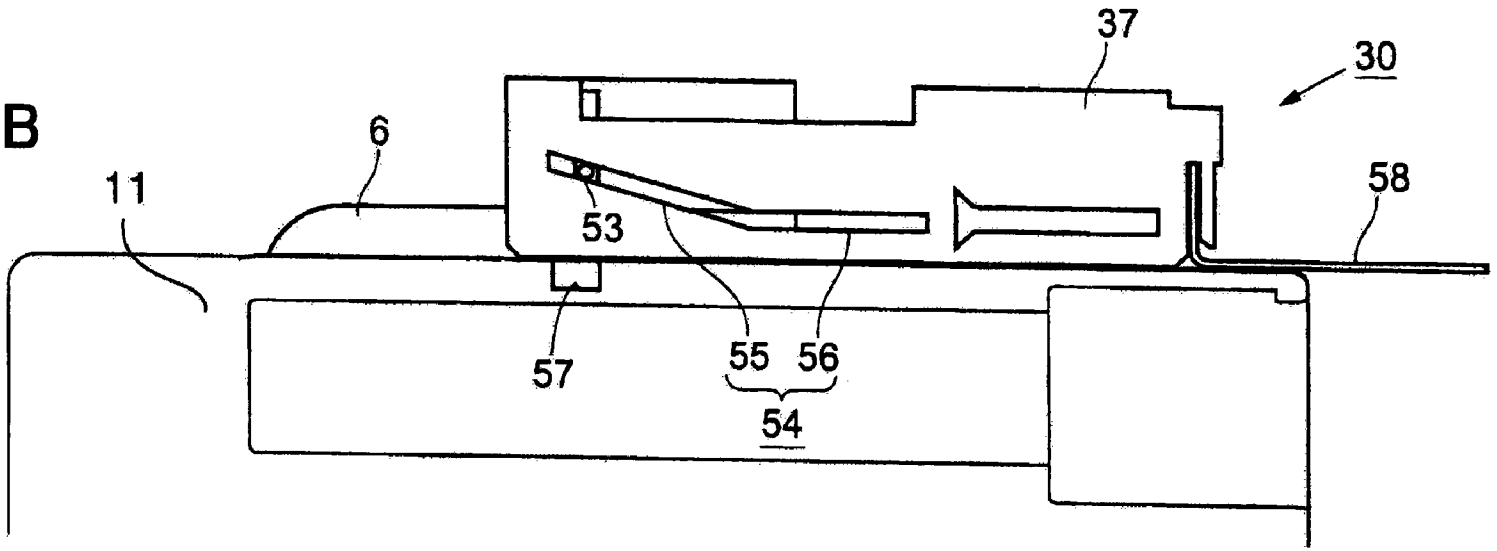
Figure 9:
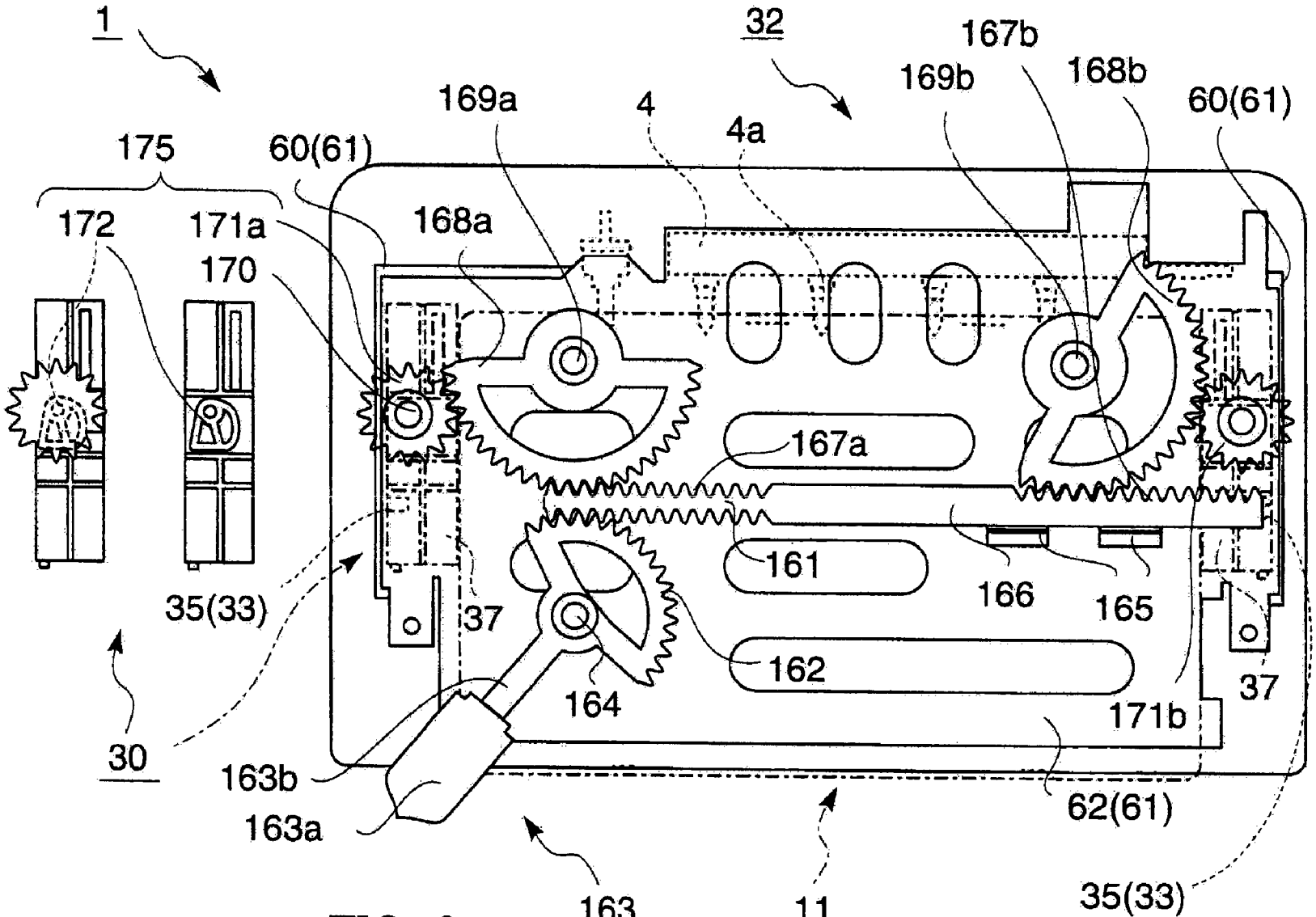
FIG. 9 is a plan view showing the attachment/detachment device when the ink cartridge is completely inserted.
Figure 10A:
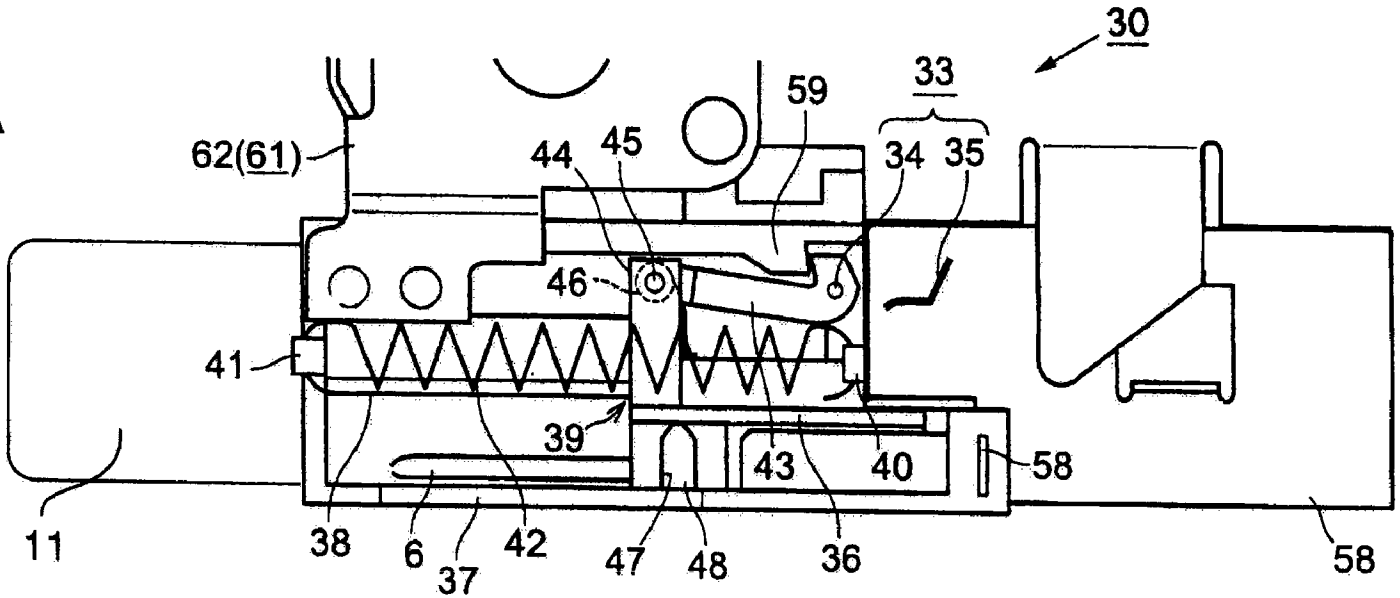
FIGS. 10A and 10B are a side view and a bottom view showing the cartridge holding mechanism when the ink cartridge is completely inserted.
Figure 10B:
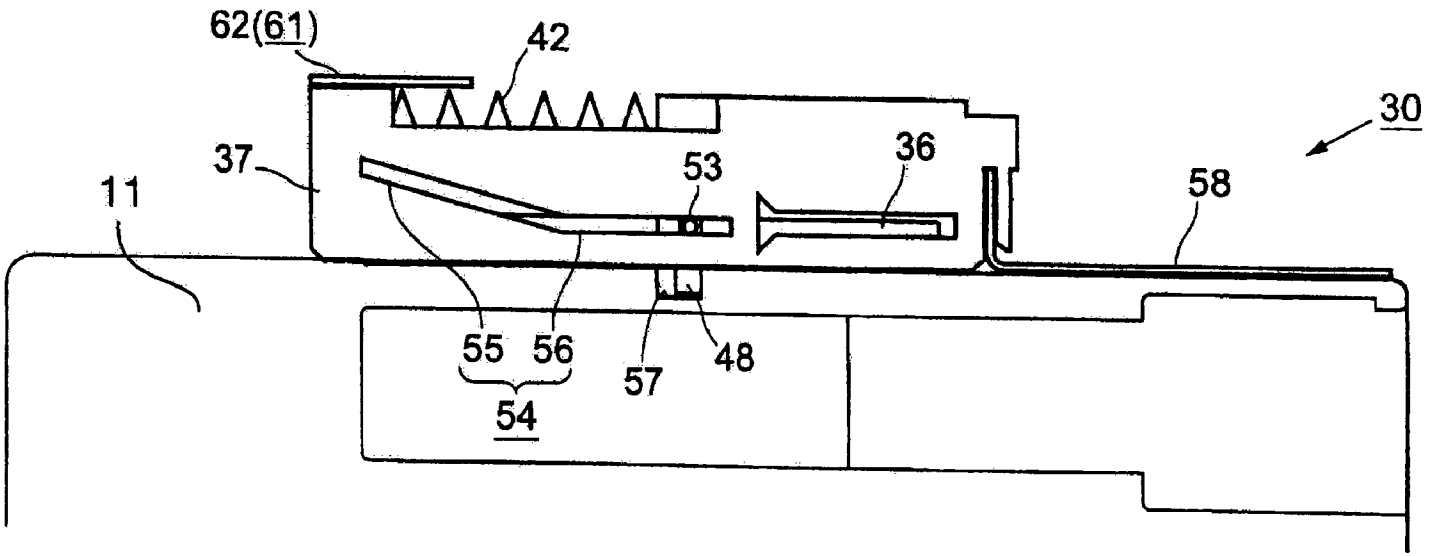

FIGS. 8A and 8B are a side view and a bottom view showing the operation state of the cartridge holding mechanism at an ink cartridge insertion start position. FIG. 9 is a plan view of the attachment/detachment device when the ink cartridge is completely inserted. FIGS. 10A and 10B are a side view and a bottom view showing the operation state of the cartridge holding mechanism at an ink cartridge insertion end position.

Figure 11:
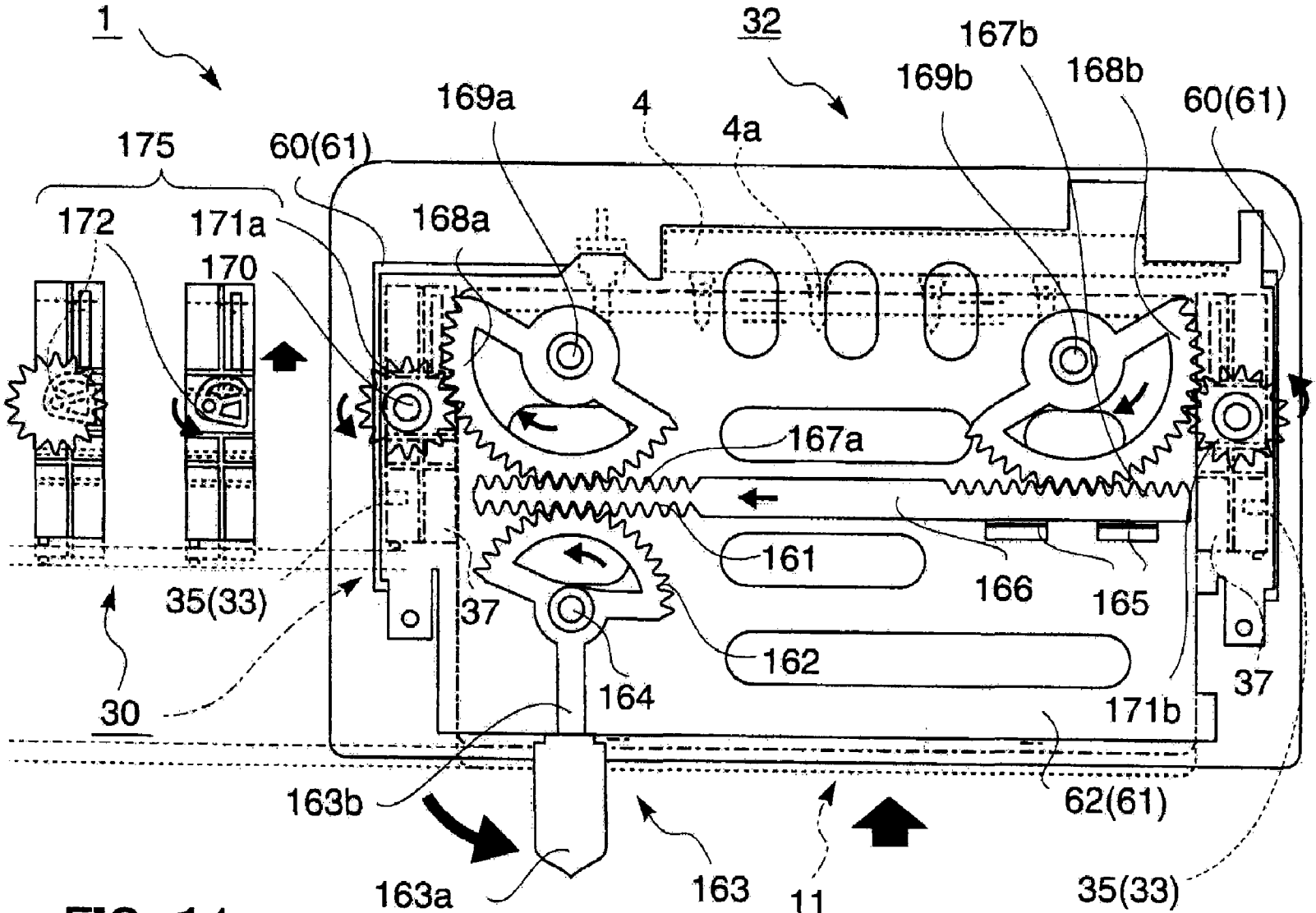
FIG. 11 is a plan view showing the attachment/detachment device where the ink cartridge is being loaded.
Figure 12A:
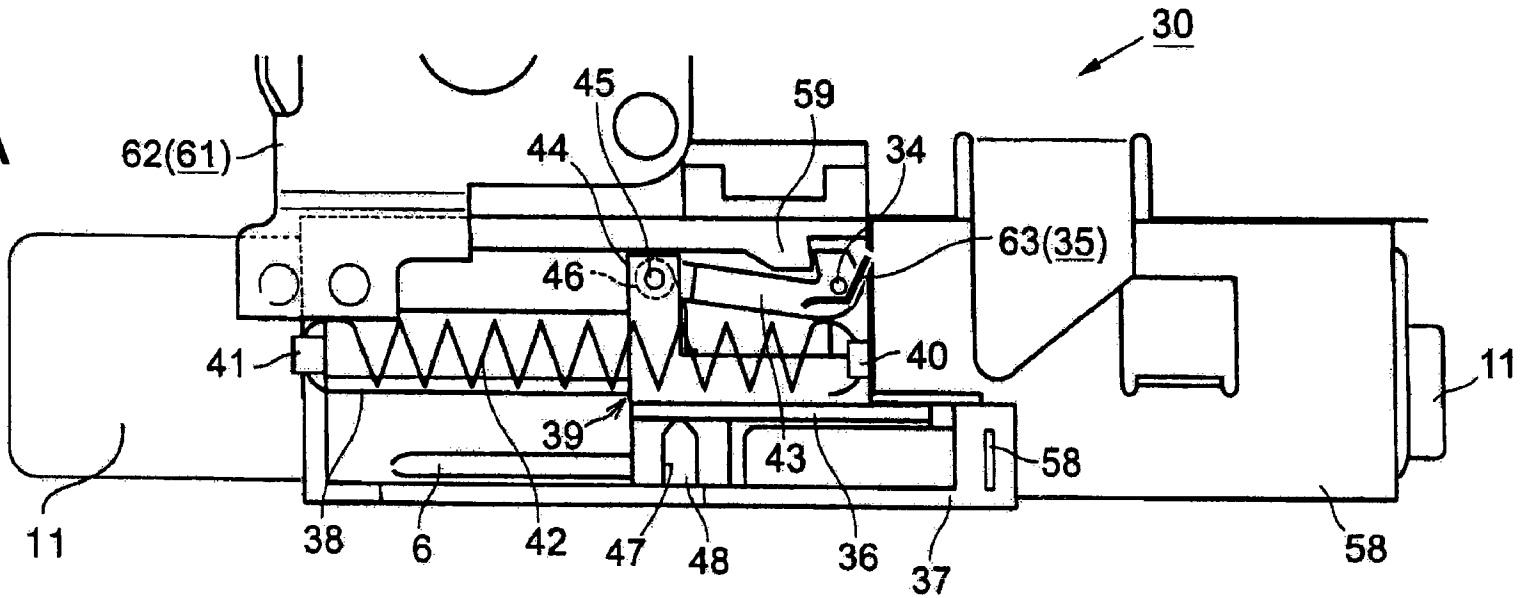
FIGS. 12A and 12B are a side view and a bottom view showing the cartridge holding mechanism when the ink cartridge is being loaded.
Figure 12B:
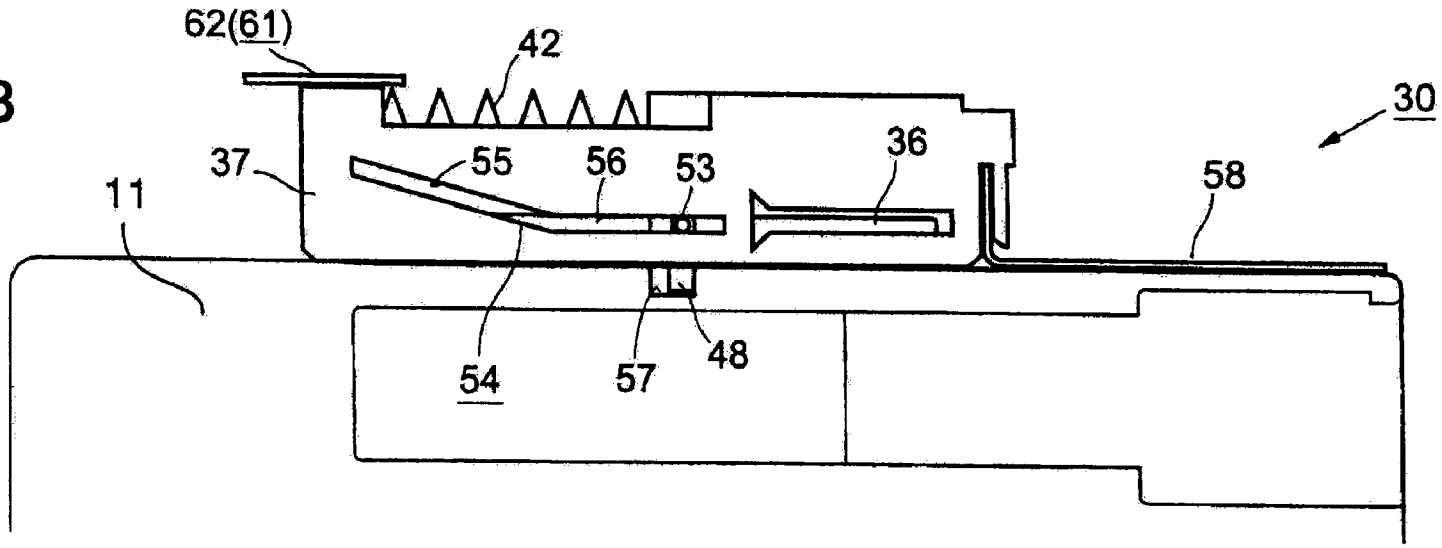
Figure 13:
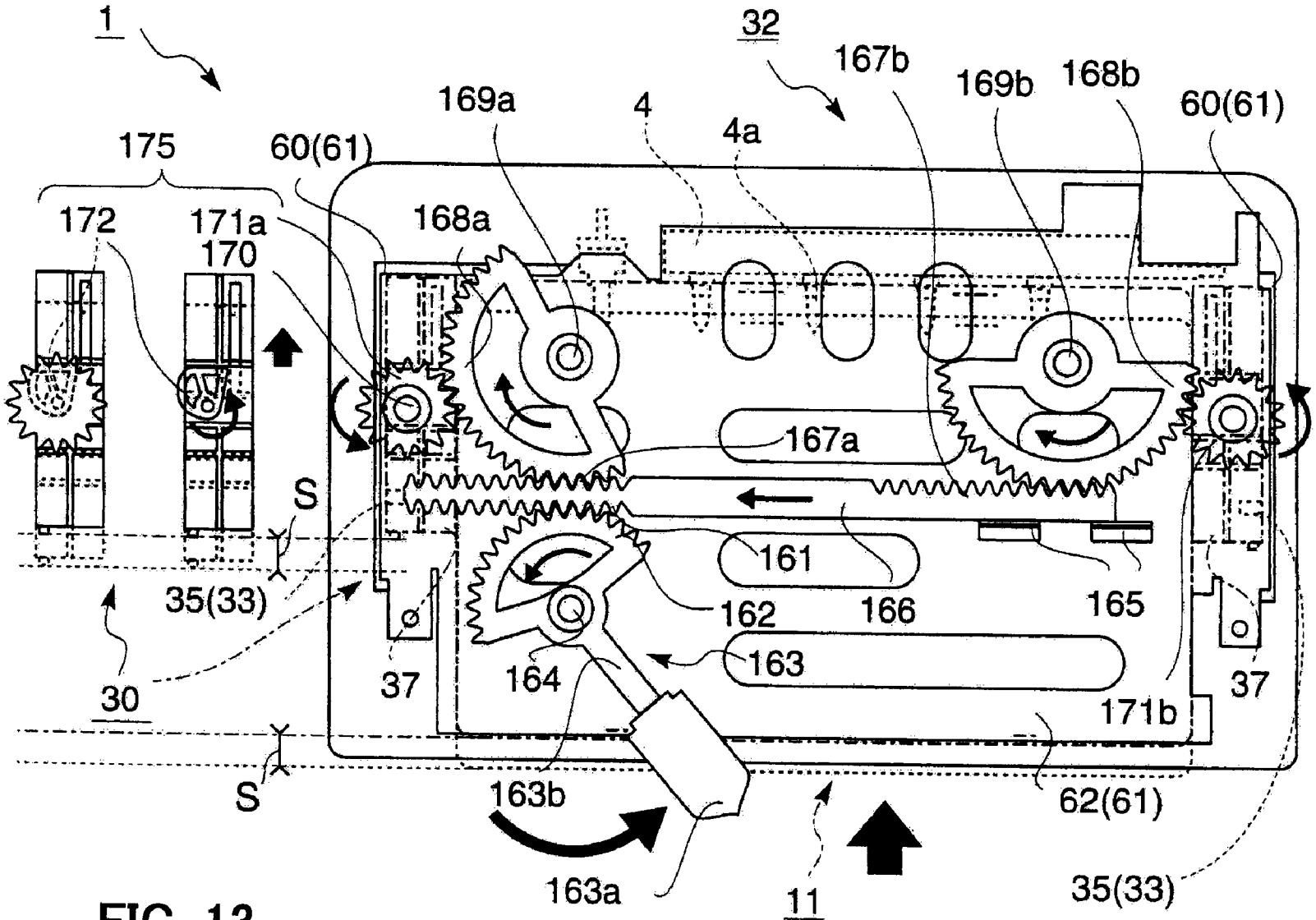
FIG. 13 is a plan view showing the attachment/detachment device when the ink cartridge is completely loaded.
Figure 14A:
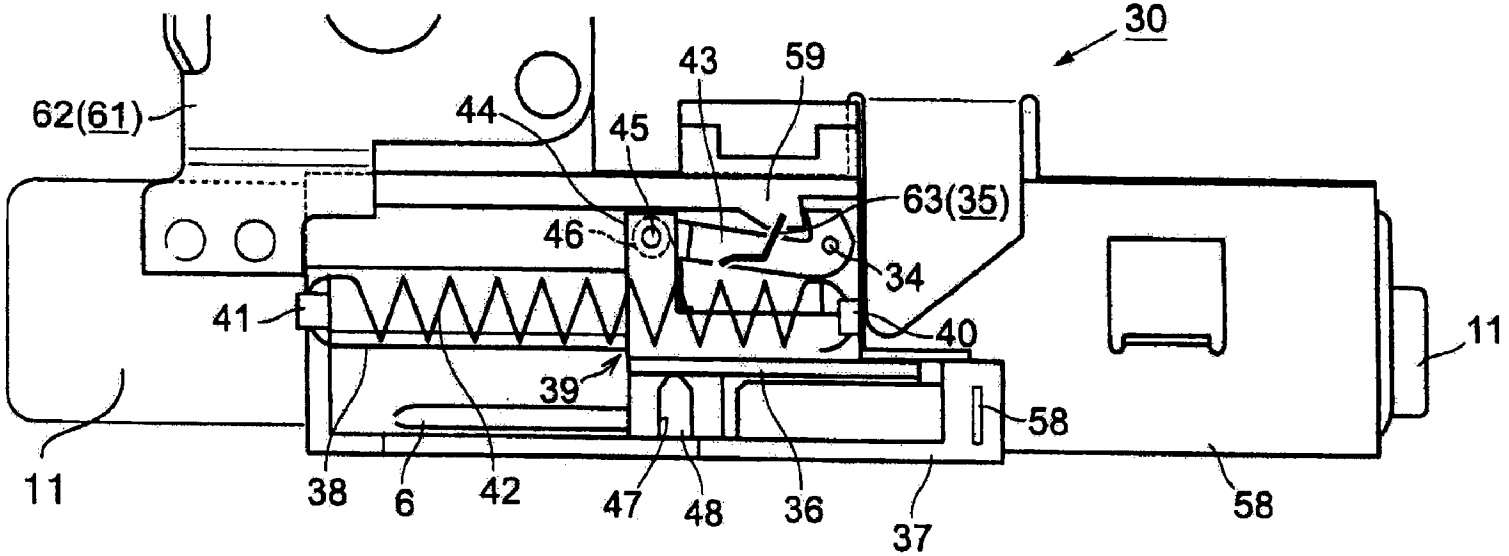
FIGS. 14A and 14B are a side view and a bottom view showing the cartridge holding mechanism when the ink cartridge is completely loaded.
Figure 14B:
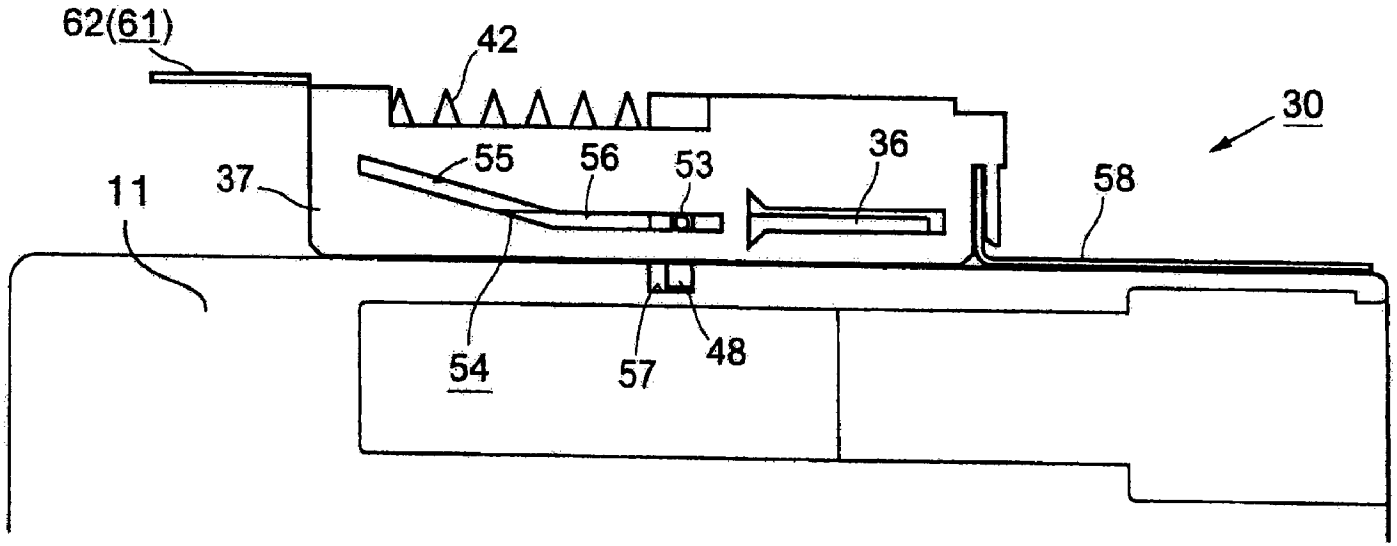
Figure 15:
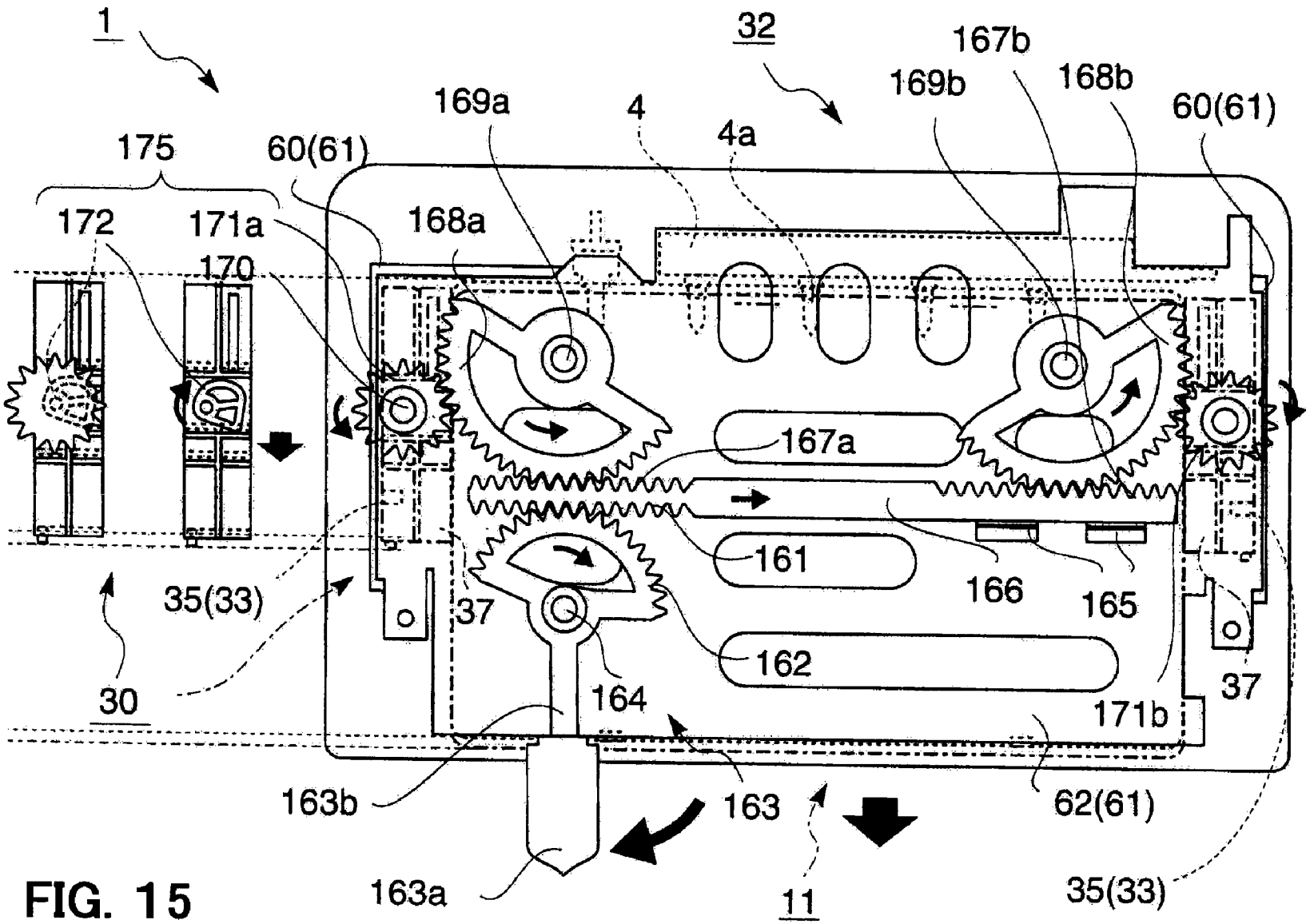
FIG. 15 is a plan view showing the attachment/detachment device when the ink cartridge is extracted.
Figure 16A:
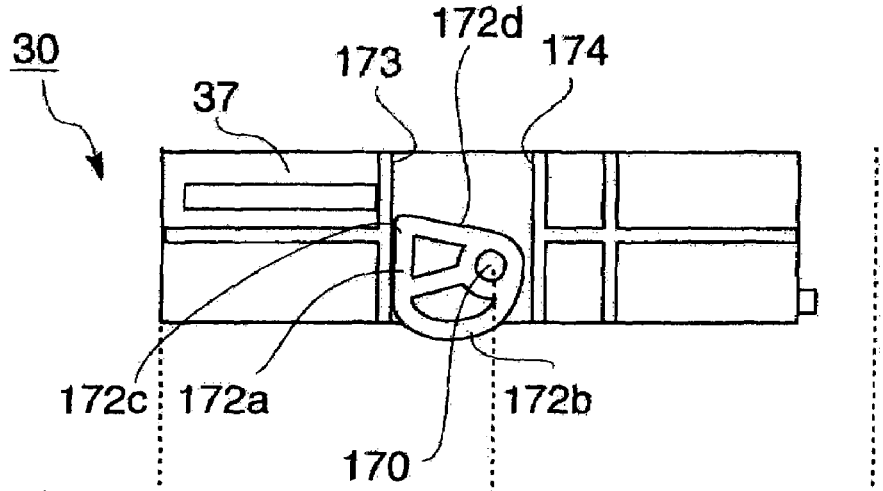
FIGS. 16A to 16C are plan views showing the operation of the eccentric cam portion when the ink cartridge is extracted.
Figure 16B:
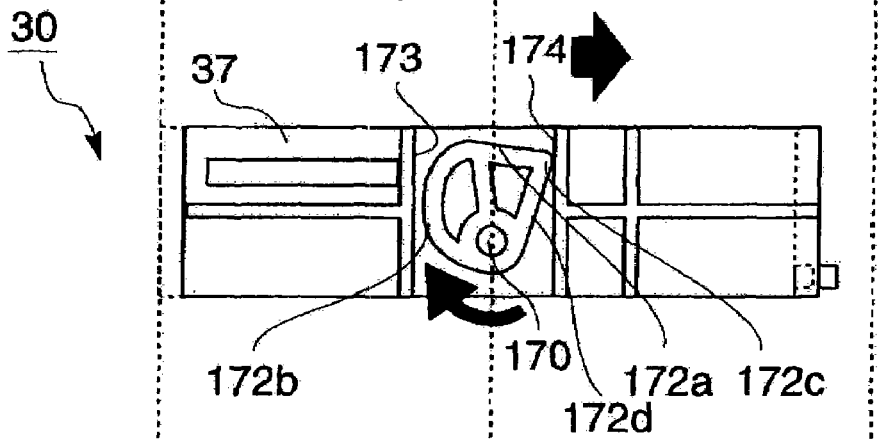
Figure 16C:
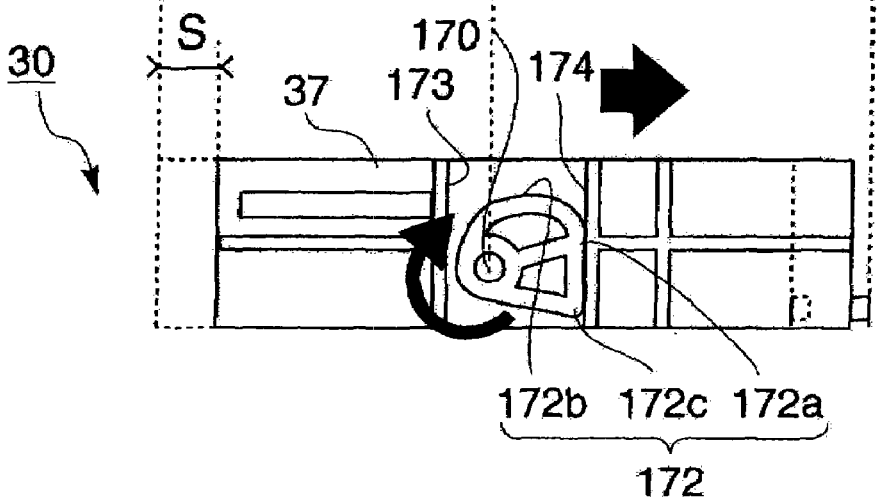
Figure 17A:
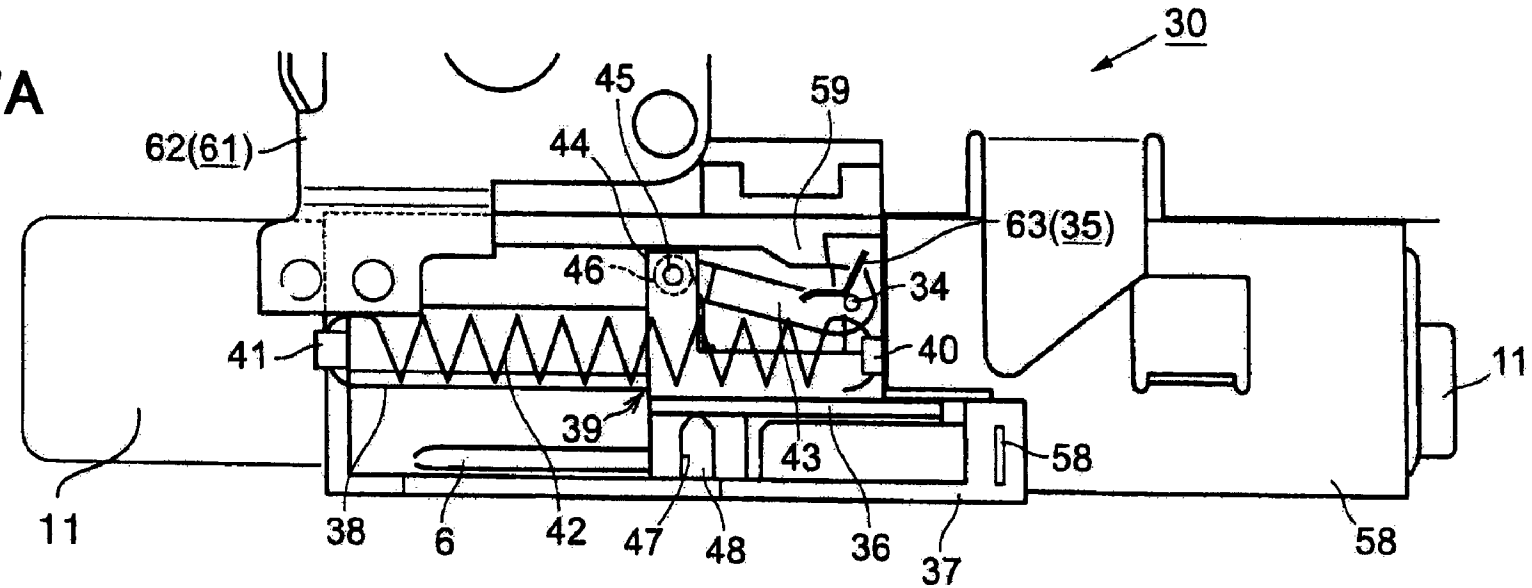
FIGS. 17A and 17B are a side view and a bottom view showing the cartridge holding mechanism when the ink cartridge is extracted.
Figure 17B:
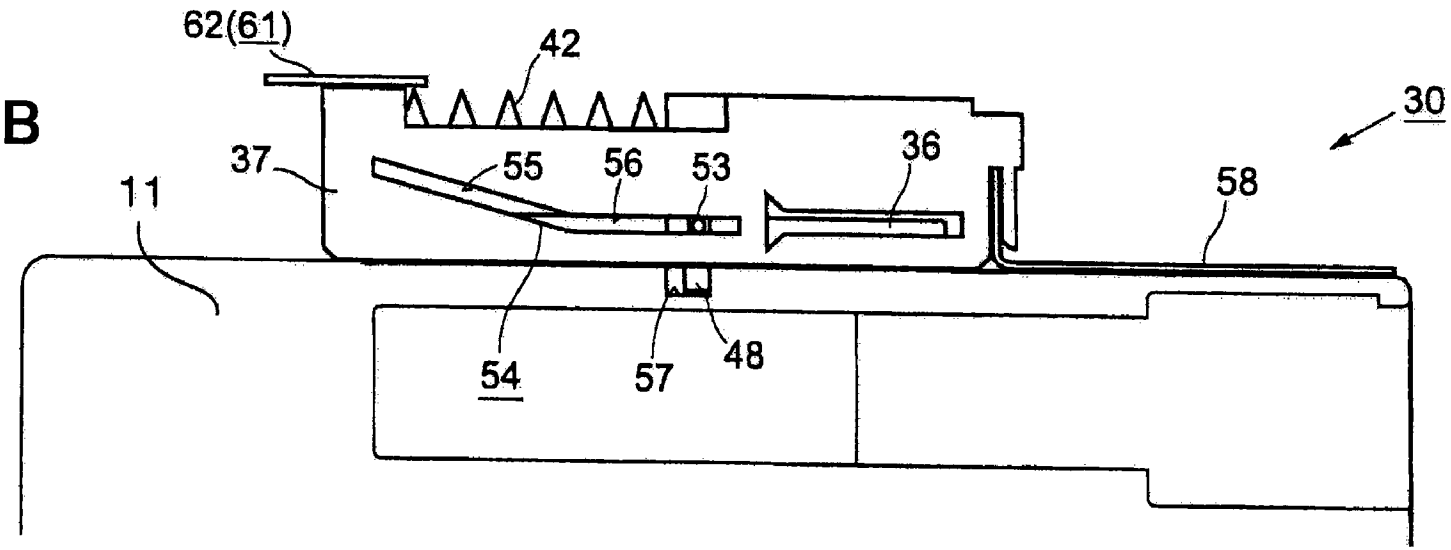

FIG. 11 is a plan view of the attachment/detachment device in a state where the ink cartridge is being loaded. FIGS. 12A and 12B are a side view and a bottom view showing the operation state of the cartridge holding mechanism in this state. FIG. 13 is a plan view of the attachment/detachment device in a state where the ink cartridge is completely loaded. FIGS. 14A and 14B are a side view and a bottom view of the cartridge holding mechanism in this state. FIG. 15 is a plan view of the attachment/detachment device in a state of an unlocking moment to extract the ink cartridge. FIGS. 16A to 16C are plan views showing the operation of the eccentric cam portion 172 when the ink cartridge is extracted. FIGS. 17A and 17B are a side view and a bottom view of the cartridge holding mechanism in this state.

Moreover, the cartridge holding mechanism and the eccentric cam portion on the left side of FIG. 3, 5, 9, 11, 13 or 15 are shown according to the arrangement states within the recording apparatus.

The ink cartridge attachment/detachment device 1 of the invention has cartridge holding mechanisms 30 that hold the ink cartridge 11 upon insertion of the ink cartridge 11 by a first predetermine stroke, and a power transmitting and converting mechanism 32 that ensures pressing force required for loading the ink cartridge 11 by using rotation of a lever arm 163 and leverage principle, and converts the rotation of the lever arm 163 into movement of a second predetermined stroke S required for loading the ink cartridge 11 held by the cartridge holding mechanisms 30. The power transmitting and converting mechanism 32 includes an eccentric cam portion 172, serving as a first cam portion, for moving the cartridge holding mechanism 30 by the second predetermined stroke S.

Of these elements, each of the cartridge holding mechanisms 30 has an unlocking mechanism 33 which is provided as one of feature components of the invention, and which permits extraction of tie ink cartridge 11 from the main body 3 of the recording apparatus only by the rotation of the lever arm 163. The unlocking mechanism 33 includes an unlocking pin 34 that is moved together with the ink cartridge 11 as the lever arm 163 rotates, and an elastic unlocking piece 35 that unlocks the ink cartridge 11 by differentiating travel loci of the unlocking pin 34 for the insertion direction and the extraction direction of the ink cartridge 11. The detailed configuration of the unlocking mechanism 33 will be described below, together with other components of the cartridge holding mechanism 30.

As shown in FIG. 7, the cartridge holding mechanism 30 includes a lock slider 36 that directly holds the ink cartridge 11, a slider holder 37 that slidably holds the lock slider 36, and the unlocking mechanism 33. The lock slider 36 is a block member that slides by coming into contact with a contact face 7 of a pressing rib 6 in FIG. 2 that protrudes from each of both side faces of the ink cartridge 11.

The lock slider 36 is moved inside the slider holder 37 such that the lock slider 36 slides on and along the inner walls of the upper and lower plates of the slider holder 37, while being guided by a guide rib 38 formed on the inner wall of the slider holder 37. The lock slider 36 is formed with an engagement groove 39 that engages with the guide rib 38 therein. An extraction spring 42, such as a tension coil spring, is suspended between engagement hooks 40 and 41 that are respectively formed on the lock slider 36 and the slider holder 37.

A bearing portion 44 is provided on the lock slider 36 to rotatably support an engagement pawl 43. The bearing portion 44 has a hole that receives a rotational shaft portion 45 disposed at the base end of the engagement pawl 43. Further, attached to the rotational shaft portion 45 is a lock spring 46, such as a helical torsion coil spring, for biasing the engagement pawl 43 toward the upper plate inner wall of the slider holder 37.

The engagement pawl 43 is a member having a hook-shaped pawl formed at a front end thereof. The unlocking pin 34, which is a part of the unlocking mechanism 33, is disposed on the outer face of the pawl in parallel. The lock slider 36 is formed with the guide concave portion 47 extending in a direction perpendicular to a load direction of the ink cartridge 11. And then, a slide lock piece 48 engages with the guide concave portion 47.

The slide lock piece 48 is a flat plate member, the front end of which is cut in a crest shape according to the shape of the guide concave portion 47 with which the slide lock piece 48 engages. The slide lock piece 48 has a guide protrusion 63 on the end face thereof opposing the lower plate of the slider holder 37. The guide protrusion 53 engages with a guide groove 54 formed in the lower plate of the slider holder 37. As the guide protrusion 53 moves in the load direction of the ink cartridge 11 along the shape of the guide groove 54, the slide lock piece 48 also slides in a direction perpendicular to the load direction of the ink cartridge 11.

That is, as shown in FIGS. 5, 8A, 8B, 10A 10B, 12A, 12B, 14A, 14B, 17A and 17B, the guide groove 54 has a slope portion 55 at a start end side where the ink cartridge 11 is inserted, and a horizontal portion 56 at a terminal end side. Further, the slope portion 55 is gradually inclined from outward to inward, and the horizontal portion 56 is continuous from an innermost end of the slope portion 55 to extend toward the terminal end in parallel with the load direction, while maintaining this position.

The guide protrusion 53 engaging with the guide groove 54 having this shape takes an outermost position when the guide protrusion 53 is located at the start end where the ink cartridge 11 is inserted. The guide protrusion 58 takes the innermost position when the guide protrusion 53 is located at the terminal end of the slope portion 55, whereby the slide lock piece 48 slides to enter into an engagement concave portion 57 in FIG. 2 that is formed in the side face of the ink cartridge 11. Accordingly, the ink cartridge 11 is held from both sides.

The slider holder 37 is a box-shaped member that has a space for housing the lock slider 36 therein. The slider holder 37 is anchored to a movable frame 58 having a portal cross section as an example, and can slide together with the movable frame 58. A hook-shaped engagement rib 59 is formed on the inner wall of the upper plate of the slider holder 37, and engages with the engagement pawl 43 that is rotatably attached to the lock slider 36. With this structure, the lock slider 36 and the slider holder 37 are combined integrally.

The outer face of the slider holder 37 is open. After the lock slider 36 and the extraction spring 42 are housed, a subframe 60 is used to externally block the open area. Moreover, the subframe 60 is a part of a fixed frame 61, and is attached to a main frame 62 of the fixed frame 61 by screws.

A flow path member 4 is attached to a rear end face of the subframe 60 to be connected to the ink cartridge 11. The flow path member 4 includes needles 4*a* to be inserted into needle insertion openings of the ink cartridge 11, an ink supply path, and a contact point for detecting the residual amount of ink. The elastic unlocking pin 35, which is a part of the unlocking mechanism 33, is attached to the subframe 60. The unlocking piece 35 is a member such as a leaf spring member, and has an elastic tongue piece 63 that extends obliquely upward. The elastic deformation of the elastic tongue piece 63 is used to differentiate the travel loci of the unlocking pin 34 for the load direction and the extraction direction of the ink cartridge 11 (see FIGS. 12A and 17A).

That is, as the elastic tongue piece 63 is bent downward, the unlocking pin 34 can move in the load direction of the ink cartridge 11, while the height of the unlocking pin 34 is maintained. In contrast, when the unlocking pin 34 moves in the extraction direction of the ink cartridge 11, the elastic tongue piece 63 is not bent upward due to an inclination direction of the elastic tongue piece 63. In this case, the unlocking pin 34 moves downward and the travel locus of the unlocking pin 34 changes. Therefore, the engagement pawl 43 integrally formed with the unlocking pin 34 pivots downward, and is disengaged from the engagement rib 59.

Further, a knob 163*a* is provided at one end of the lever arm 163, that is, an arm main body 163*b*. A first pinion 162 having a fan shape, which is an example of a transmission member in the power transmitting and converting mechanism 32, is provided at the other end of the arm main body 163*b* and is attached to rotate about a first rotation pin 164 serving as a fulcrum. A ratio of a distance between the fulcrum and an operation point of the ever arm 163 to a pitch circle radius of the first pinion 162 is used substantially as a leverage ratio. As the distance between the fulcrum and the operation point can be comparatively increased by using the lever arm 163, a large leverage ratio is obtained.

A rack, pinion and cam mechanism can be used as an example of the power transmitting and converting mechanism 32. In this embodiment, the power transmitting and converting mechanism 32 includes the first pinion 162 that rotates together, with the lever arm 163, a slide bar 166 that has a first rack 161 meshing with the first pinion 162 and second racks 167 to transmit the movement of the first rack 161 downstream along a transmission path, second pinions 168 that mesh with the second racks 167, a geared cam unit 175 that has gears 171 meshing with the second pinions 168 and an eccentric cam portion 172 to transmit the rotation of the gears 171 downstream along the transmission path, and a first wall portion 173 that is provided close to the cartridge holding mechanism to be brought into contact with the eccentric cam portion 172 when the ink cartridge 11 moves in a push-in direction.

In this embodiment, the slider bar 166 has the first rack 161 located on a side opposing the first pinion 162, and the second racks 167*a* and 167*b* located on sides opposing the second pinions 168*a* and 168*b*. In addition, the slide bar 78 is guided by the first pinion 162 and the second pinion 168*a* on the first pinion 168*a* side, and is guided by guide ribs 165 of the main frame and the second pinion 168*b* on the second pinion 168*b* side, to thereby reciprocate in a widthwise direction of the main body 3 of the recording apparatus.

Like the first pinion 162, the second pinions 168*a* and 168*b* are formed of fan-shaped gears, and rotate in the same direction about second rotation pins 169*a* and 169*b* serving as fulcrums to transmit power to the gears 171*a* and 171*b*, respectively. The gears 171 (171*a* and 171*b*) rotate about a third rotation pin 170 serving as a fulcrum together with the eccentric cam portion 172 integrally formed with the gears 171. The eccentric cam portion 172 is brought into contact with the first wall portion 173 and the second wall 174 provided in the slider holder 37 of the cartridge holding mechanism 30 to thereby move the slider holder 37.

A description will now be given for the operation states of the ink cartridge attachment/detachment device 1 having the above-described configuration.

(1) Before Insertion (See FIGS. 2, 3, 5 to 7)

Before the ink cartridge 11 is inserted into the main body 3 of the recording apparatus, as shown in FIG. 3, the lever arm 163 is located at a leftmost position. In this state, the lock sliders 36 are located closest to the start end, and the engagement pawls 43 are in contact with the inner walls of the upper plates of the slider holders 37. As shown in FIG. 56 the guide protrusions 53 are located at the start end positions, which are the outermost positions in the slope portions 55 of the guide grooves 54. Therefore, the slide lock pieces 48 are housed in the guide concave portions 47, such that the insertion of the ink cartridge 11 is permitted.

(2) Start Insertion (See FIGS. 8A and 8B)

When the ink cartridge 11 is manually inserted from the opening in the rear face of the main body 3 of the recording apparatus, the contact faces 7 at the front ends of the pressing ribs 6, which are formed on both side faces of the ink cartridge 11, are brought into contact with the end faces of parts where the guide concave portions 47 are formed, and gradually push the lock sliders 36 forward against biasing force of the extraction springs 42. Accordingly, the guide protrusions 53 move forward in the main body 3 along the slop portions 55 and the horizontal portions 56 of the guide grooves 54. As the guide protrusions 53 move forward, the slide lock pieces 48 gradually move inwardly and then protrude.

(3) Completion of Insertion (See FIGS. 9, 10A and 10B)

When the ink cartridge 11 is fully pushed in, that is, a first predetermined stroke, upon generation of clicking sound, the engagement pawls 43 move over the rear faces of the engagement ribs 59 and engage with the engagement ribs 59. In this state, the lock sliders 36 are combined integrally with the slider holders 37, and the guide protrusions 53 reach the terminal ends of the horizontal portions 56 of the guide grooves 54. The slide lock pieces 48 completely protrude inwardly, and enter into the engagement concave portions 57 that are formed in both side faces of the ink cartridge 11. In this manner, the ink cartridge 11 is locked and held by the lock sliders 36.

(4) Loading (See FIGS. 4A to 4C, 11, and 12A and 12B)

As shown in FIG. 11, when the lever arm 163 gradually pivots to the right by using the knob 163*a* of the lever arm 168, the first pinion 162 rotates, and rotation force is transmitted to the first rack 161 to move the slider bar 166 to the right. Then, the force is transmitted from the second racks 167 to the gears 171 through the second pinions 168, such that the gears 171 rotate in a counterclockwise direction in FIG. 11. Accordingly, the eccentric cam portion 172 integrally formed with the gears 171 rotates in a counterclockwise direction. As shown in FIGS. 4A to 4C, the eccentric cam portion 172 gradually rotates from the state shown in FIG. 4A in the counterclockwise direction.

Then, as shown in FIG. 413, the cam are portion 172*b* is pressed into contact with the first wall portion 173 to move the slider holders 37. If the slier holders 37 move, the ink cartridge 11, the movable frame, and the slider holders 37 integrally move toward the rear by the cartridge holding mechanisms 30. At this time, when the gears 171 rotate at a constant speed, the cam arc portion 172*b* of the eccentric cam portion 172 is provided to press the first wall portion 173 at constant speed and force. That is, while the eccentric cam portion 172 rotates by 180°, the slider holders 37 move at an almost constant speed.

Moreover, in this state, as shown in FIGS. 12A and 12B, the unlocking pins 34 are located in front of the elastic tongue pieces 63 of the elastic unlocking pieces 35, and move forward along the upper travel locus. Further, the slider lock pieces 48 currently protrude, and enter into the engagement concave portions 57. Accordingly, the ink cartridge 11 is locked and held by the lock sliders 36.

(5) Completion of Loading (See FIGS. 4A to 4C, 13, and 14A and 14B)

When the lever arm 163 pivots to the rightmost position as shown in FIG. 13, the ink cartridge 11 enters more into the rear, and the needles 4*a* formed on the flow path member 4 are inserted into the needle insertion openings of the ink cartridge 11. Specifically, when the eccentric cam portion 172 pivots from the state shown in FIG. 4B in the counterclockwise direction, and a part where the leverage length of the cam at the boundary between the cam arc portion 172*b* and the cam chord portion 172*a* immediately before the state of FIG. 14C becomes maximum is brought into contact with the first wall portion 173, the maximum push-in position of the cartridge holding mechanism is provided. Then, as shown in FIG. 4C, the cam chord portion 172*a* rotates to be brought into face contact with the first wall portion 173. At this time, the cartridge holding mechanism is pushed back from the maximum push-in position by about 0.5 mm. Therefore, when the cam chord portion 172*a* rotates at that position, the needles 4*a* are sufficiently inserted into the needle insertion openings of the ink cartridge 11. As a result, loading of the ink cartridge 11 is completed.

Moreover, in this state, as shown in FIGS. 14A and 14B, the unlocking pins 34 pass over the elastic tongue pieces 63 and are located behind the elastic tongue pieces 63. Further, the slide lock pieces 48 protrude, and the ink cartridge 11 is held by the lock sliders 36.

(6) Removing (See FIGS. 15, 16A to 16C, and 17A and 17B)

When the lever arm 163 pivots from the rightmost position to the left as shown in FIG. 15, the eccentric cam portion 172 rotates in a clockwise direction as shown in FIGS. 16A to 16C, the angular portion 172*c* of the eccentric cam portion 172 is pressed into contract with the second wall portion 174 to move the slider holders 37 in a direction opposite to the load direction. Then, as shown in FIGS. 17A and 17B, the unlocking pins 34 move downward along the slopes of the elastic tongue pieces 63, pass under the elastic tongue pieces 63 along the lower travel locus, and reach in front of the elastic tongue pieces 63. At this time, the engagement pawls 43, which are integrally formed with the unlocking pins 34, also rotate downward against the biasing force of the lock springs 46, and are disengaged from the engagement ribs 59. Then, when the lever arm 163 moves to the leftmost position shown in FIG. 3, the ink cartridge 11 is ejected by a distance of 22 mm or more from the rear end face of the main body 8 of the recording apparatus by biasing force of the extraction spring 42. Therefore, the ink cartridge 11 is removed.

At this time, even when the lever arm 163 rotates at a uniform speed, the speed of the slider holder 37 to be moved by the rotation of the eccentric cam portion 172 is differentiated for the load and extraction of the ink cartridge 11. That is, the speed is constant when the ink cartridge 11 is loaded, while the speed is not constant when the ink cartridge 11 is extracted. A description will now be given for the operation when the ink cartridge 11 is extracted.

First, when the eccentric cam portion 172 rotates in the clockwise direction from the position shown in FIG. 16A, the slider holder 37 does not move until the angular portion 172*c* is brought into contact with the second wall portion 174. Subsequently, as shown in FIG. 16B, the speed v when the angular portion 172*c* is brought into contact with the second wall portion 174 is represented by the following expression.

$$v=A\omega \cos \omega t \text{ (where A is a constant)}$$

That is, when the eccentric cam portion 172 rotates from the position shown in FIG. 16B to the position shown in FIG. 16C, the slider holder 37 moves at a speed orthographically projected on an x axis of a uniform circular movement because only the angular portion 172*c* is brought into contact with the second wall portion 174. Accordingly, at a position of the eccentric cam portion 172 shown in FIG. 16B, the speed of the slider holder 87 is Max. Then, as the eccentric cam portion 172 rotates to a position shown in FIG. 16C, the speed of the slider holder 37 is gradually decreased and then halted.

That is, when the speed of the slider holder 37 is Max, and the needles 4*a* are pulled out from the ink cartridge 11, the time of the stuck state of the needles 4*a* halfway can be shortened. As a result, when the ink cartridge 11 is extracted, ink leakage due to the stuck state of the needles 4*a* halfway can be reduced.

Moreover, in this embodiment, a line portion 172*d*, which connects the angular portion 172*c* and the rotation fulcrum, is not brought into contact with the first wall portion 173 and the second wall portion 174. However, a swelled portion of a small arc shape may be brought into contact with the second wall portion 174. With the line portion 172*d* of a small arc shape, a speed and timing for pulling the needles 4*a* out from the ink cartridge 11 can be changed.

The power transmitting and converting mechanism 32 of the ink cartridge attachment/detachment device 1 according to the invention has the eccentric cam portion 172, serving as the first cam portion, for moving the cartridge holding mechanism 30 by the second predetermined stroke S. As a result, the ink cartridge 11 can be securely pushed by the second predetermined stroke S. That is, when the cartridge holding mechanism 30 is pushed by the eccentric cam portion 172 serving as a cam mechanism, accurate positioning can be constantly performed.

The power transmitting and converting mechanism 32 of the invention has the first rack 161 and the second racks 167 serving as racks, the first pinion 162 and the second pinion 168*b* serving as pinions, the gears 171*a* and 171*b*, and the eccentric cam portion 172 serving as a cam mechanism.

As a result, a comparatively simple configuration can be used to convert the rotation of the lever arm 163 into the movement of the cartridge holding mechanism 30 or the ink cartridge 11 held by the cartridge holding mechanism 30, the movement being the movement of the second predetermined stroke S required for loading the ink cartridge 11. Further, the use of the rack results in increasing a transmission path or an operation length, and thus the number of parts can be reduced, as compared with a case where multiple gear trains are used to provide the transmission path.

In addition, the power transmitting and converting mechanism 32 of the invention includes the first pinion 162 that is attached to the base end of the lever arm 163 to rotate together with the lever arm 163, the slide bar 166 that has the first rack 161 meshing with the first pinion 162 and the second racks 167 for transmitting the movement of the first rack 161 downstream along the transmission path, the second pinions 168 that mesh with the second racks 167, the geared cam unit 175 that has the gears 171 meshing with the second pinions 168, together with the eccentric cam portion 172 for transmitting the rotation of the gears 171 downstream along the transmission path, and the first wall portion 173 that is provided close to the cartridge holding mechanism to be brought into contact with the eccentric cam portion 172 when the ink cartridge 11 moves in a push-in direction.

As a result, since the eccentric cam portion 172 is provided lowermost stream along the transmission path, last pressing of the ink cartridge 11 is performed by the eccentric cam portion 172. Therefore, even though a backlash occurs in the pinion and the rack upstream along the transmission path, the second predetermined stroke S can be uniformly maintained with high accuracy because the eccentric cam portion 172 is brought into direct contact with the first wall portion 173 and pushes the cartridge holding mechanism 30 by the second predetermined stroke S. That is, the backlash upstream along the transmission path can be eliminated by the eccentric cam mechanism.

Further, the power transmitting and converting mechanism 32 includes the second wall portion 174 that is provided close to the cartridge holding mechanism to be brought into contact with the eccentric cam portion 172 when the ink cartridge 11 moves in a push-out direction.

As a result, the ink cartridge 11 can be securely pushed out by the second predetermined stroke S. Therefore, the needles 4*a* can be securely pulled out from the ink cartridge 11.

The eccentric cam portion 172 of the invention has the angular portion 172*c* at the position where the distance from the rotation fulcrum of the eccentric cam portion 172 becomes maximum. The angular portion 172*c* is brought into contact with the second wall portion 174 when the ink cartridge 11 is pulled out.

As a result, the use of the angular portion 172*c* at the position where the distance from the rotation fulcrum of the eccentric cam portion 172, called a leverage length, becomes maximum results in providing a change in travel speed of the second wall portion 174 serving as an operating portion. Therefore, a speed when the ink cartridge 11 is pushed out, in particular, a speed of the moment when the needles 4*a* are pulled out from the ink cartridge 11 can be made fast. Consequently, the time of the stuck state of the needles 4*a* halfway can be shortened, and thus ink leakage due to the stuck state of the needles 4*a* halfway can be reduced.

Further, the eccentric cam portion 172 of the invention has the cam chord portion 172*a* serving as a chord portion, and the cam arc portion 172*b* serving as an arc portion. As a result, the first wall portion 173 and the second wall portion 174 serving as contact portions of the cam chord portion 172*a* and the cartridge holding mechanism 30 can be brought into face contact with the cam chord portion 172*a*, thereby providing a stable position. That is, in case that the ink cartridge 11 is pushed by the second predetermined stroke S, even though force against the pressing force of the ink cartridge 11, that is, force for releasing the ink cartridge 11 from the needles 4*a*, is applied, the cartridge holding mechanism 30 can continue to be stably located at a predetermined position where the ink cartridge 11 is pushed by the second predetermined stroke S, without rotating the eccentric cam portion 172.

Further, when the contact point of the eccentric cam portion 172 to the cartridge holding mechanism 30 is switched from the cam arc portion 172*b* to the cam chord portion 172*a*, that is, as described above, the contact portions of the cartridge holding mechanism 30 is brought into face contact with the cam chord portion 172*a*, the cartridge holding mechanism 30 is slightly pushed back from the maximum push-in position by the force for releasing the ink cartridge 11 from the needles 4*a*. That is, the force for releasing the ink cartridge 11 from the needles 4*a* can be reduced by the amount that the cartridge holding mechanism 30 is slightly pushed back. As a result, force to be accumulated in the attachment/detachment device can be reduced, and thus each member can be prevented from deforming under a high-temperature condition.

Other Embodiments

The ink cartridge attachment/detachment device described above slides the ink cartridge by the first predetermined stroke, and holds the ink cartridge by the cartridge holding mechanism 30. Therefore, the ink cartridge is moved and loaded. That is, the ink supply needles are constantly fixed, while the ink cartridge constantly moves from insertion to loading.

Moreover, an ink cartridge attachment/detachment device of another embodiment, after the ink cartridge is inserted and held by the cartridge holding mechanism, the ink supply needles first move toward the ink cartridge, and loading is completed. A description thereof will now be given in detail.

Figure 18:
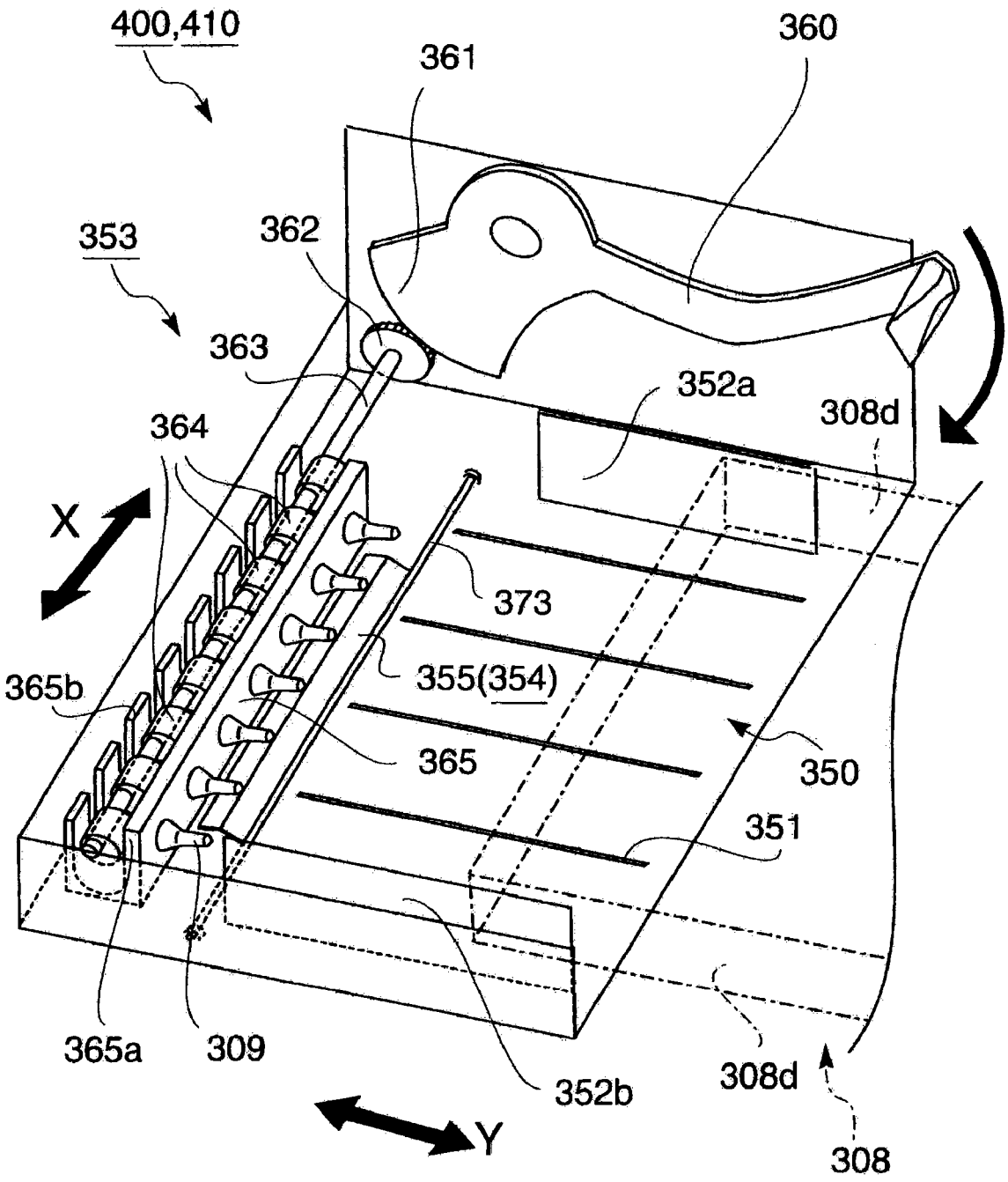
FIG. 18 is a perspective view of an attachment/detachment device according to another embodiment of the invention.

FIG. 18 is a perspective view of an attachment/detachment device 410 according to another embodiment of the invention.

FIGS. 19A and 19B are enlarged side views of the attachment/detachment device 410 according to another embodiment of the invention. Specifically, FIG. 19A shows a state before the ink cartridge is completely inserted and loaded and FIG. 19B shows a state when the ink cartridge is completely inserted and loaded.

As shown in FIG. 18, in a main frame 350 of a recording apparatus 400, guide ribs 351 which support an ink cartridge 908 downward when the ink cartridge 308 is inserted are provided. Further, when the ink cartridge 308 is inserted, guides 352*a* and 352*b* which are brought into contact with side faces 308*d* of the ink cartridge 308 to regulate the widthwise direction are provided.

The ink cartridge attachment/detachment device 410 includes a lever arm 360, a power transmitting and converting mechanism 353, and a cartridge holding mechanism 354. Of these elements, the power transmitting and converting mechanism 353 includes a fifth gear 361, a sixth gear 362, a cam shaft 363, second cam portions 364, and a flow path unit 365. Further, the cartridge holding mechanism 354 includes an engagement member 355.

On the rear side of the drawing, the lover arm 360 which is operated by a user when the ink cartridge 308 is attached or detached is provided. The lever arm 360 is provided with the fifth gear 361. Power of the fifth gear 361 is transmitted to the sixth gear 362, and the sixth gear 362 rotates about the cam shaft 363 extending in a longitudinal direction (main scanning direction X) along the insertion face of the ink cartridge 308 as a fulcrum to reciprocate the flow path unit 365 in an insertion direction Y of the ink cartridge through a plurality of second cam portions 364. At this time, the flow path unit 365 is provided with a plurality of ink supply needles 309. Each of the second cam portions 364 is provided between the ink supply needles 309 in the main scanning direction X, and reciprocates while being pressed into contact with a first wall portion 365*a* or a second wall portion 365*b*.

The engagement member 355 which engages with the ink cartridge 308 extends in the longitudinal direction X of the ink cartridge 308 in the mainframe 350 close to the ink supply needles 309. The engagement member 355 is biased upward by an engagement spring 366 (see FIGS. 19A and 19B) and rotates about a strut 373 as a fulcrum.

As shown in FIG. 19A, at the lower face of the ink cartridge 308, a concave portion 308*b* and a cartridge engagement portion 308*a* are provided. When the ink cartridge 308 is inserted in an arrow direction, the engagement member 355 is brought into contact with the cartridge engagement portion 308*a* and retracted downward once. Then, after the cartridge engagement portion 308*a* passes over the engagement member 355, the engagement member 355 moves to the concave portion 308*b* again by force of the engagement spring 366. At this time, upon generation of clicking sound, the engagement member 355 and the cartridge engagement portion 308*a* engage with each other, and the ink cartridge 308 inserted by the first predetermined stroke is completely inserted. That is, the ink cartridge 308 is held by the cartridge holding mechanism 354.

Subsequently, after the ink cartridge is completely inserted, the lever arm 360 shown in FIG. 18 rotates in the arrow direction, and then the ink cartridge is loaded.

As shown in FIG. 19B, when the fifth gear 361 rotates in the clockwise direction by the rotation of the lever arm 360, the sixth gear 362 rotates by 180° in the counterclockwise direction. The sixth gear 362 rotates in synchronization with the cam shaft 363 to rotate the second cam portions 364 by 180°. The second cam portions 364 are pressed into contact with the first wall portion 365*a* formed in the flow path unit 365 to move the flow path unit 365 by the second predetermined stroke S in a right direction of the drawing. At this time, the ink supply needles 309 formed in the flow path unit 365 are inserted into needle insertion openings 308*c* formed in the ink cartridge 308, and thus the ink cartridge is completely loaded.

When the ink cartridge 308 is extracted, the lever arm 360 shown in FIGS. 19A and 19B rotates in a counterclockwise direction opposite to the rotation direction when the ink cartridge is loaded, and the sixth gear 362 rotates by 180° in the clockwise direction. Therefore, the second cam portions 364 rotate by 180° from the position shown in FIG. 19B in the clockwise direction about the cam, shaft 863 as a fulcrum. Then, the second cam portions 364 are separated from the first wall portion 365*a* and pressed into contact with the second wall portion 365*b* formed at a position opposing the first wall portion 365*a* to move the flow path unit 365 in a left direction of the drawing. At this time, the ink supply needles 309 formed in the flow path unit 365 are pulled out from the needle insertion openings 308*c* formed in the ink cartridge 308 and take the state shown in FIG. 19A.

When the lever arm 360 further rotates in the counterclockwise direction, a disengaging member (not shown) is pushed down the engagement member 355 against biasing force of the engagement spring 366. Therefore, the cartridge engagement portion 308*a* and the engagement member 355 are disengaged from each other, thereby extracting the ink cartridge 308. Here, in order to facilitate the extraction of the ink cartridge 308, a spring may be provided such that the ink cartridge 308 projects by spring force.

The ink cartridge attachment/detachment device 410 of the invention, which loads the ink cartridge 308 into the main body of the recording apparatus 400 by sliding the ink cartridge 308, includes the cartridge holding mechanism 354 that holds the ink cartridge 308 upon insertion of the ink cartridge 308 by a first predetermined stroke, and the power transmitting and converting mechanism 353 that ensures pressing force required for loading the ink cartridge 308 by using the rotation of the lever arm 360 and leverage principle, and converts the rotation of the lever arm 360 into the movement of the second predetermined stroke S required for loading the ink cartridge 308 held by the cartridge holding mechanism 354. The power transmitting and converting mechanism 353 includes the second cam portions 364 for moving the flow path unit 365 having the ink supply needles 309 to be inserted into the ink cartridge 308 by the second predetermined stroke S.

As a result, the flow path unit 365 having the ink supply needles 309 can be securely pushed relative to the ink cartridge 308 by the second predetermined stroke S. That is, when the flow path unit 365 is pushed by the second cam portions 364 serving as a cam mechanism, accurate positioning can be constantly performed.

As described above, even when the second cam portions 364 move the flow path unit 365 by the second predetermined stroke S, the same advantages as those of a case where the cartridge holding mechanism 30 moves by the second predetermined stroke S can be obtained. Therefore, the configuration of the eccentric cam portion 172 can be used in the configuration of the second cam portions 364.

Moreover, the invention is not limited to the above-described embodiments, but various modifications, which still fall within the scope of the invention, can be made within the scope of the invention read on the appended claims.

What is claimed is:

1. An ink cartridge attachment/detachment device, which loads an ink cartridge into a main body of a recording apparatus by sliding the ink cartridge, the ink cartridge attachment/detachment device comprising a cartridge holding mechanism that holds the ink cartridge upon insertion of the ink cartridge by a first predetermined stroke; and a power transmitting and converting mechanism that ensures pressing force required for loading the ink cartridge by using rotation of a lever arm and leverage principle, and converts the rotation of the lever arm into movement of a second predetermined stroke required for loading the ink cartridge held by the cartridge holding mechanism, wherein the power transmitting and converting mechanism includes, a first cam portion for moving the cartridge holding mechanism by the second predetermined stroke, and a rack, pinion and cam mechanism that includes;

a first pinion that is attached to a base end of the lever arm to rotate together with the lever arm, a slide bar that has a first rack meshing with the first pinion and a second rack for transmitting movement of the first rack downstream along a transmission path, a second pinion that meshes with the second rack, a geared cam unit that has a gear meshing with the second pinion, together with the first cam portion for transmitting rotation of the gear downstream along the transmission path, and a first wall portion that is provided on the cartridge holding mechanism to be brought into contact with the first cam portion when the ink cartridge moves in an insertion direction.

2. The ink cartridge attachment/detachment device according to claim 1, wherein the power transmitting and converting mechanism includes a second wall portion that is provided on the cartridge holding mechanism to be brought into contact with the first cam portion when the ink cartridge moves in a withdrawal direction.

3. The ink cartridge attachment/detachment device according to claim 2, wherein the first cam portion has an angular portion at a position where a distance from a rotation fulcrum of the first cam portion is a maximum, and when the ink cartridge is withdrawn, the angular portion is brought into contact with the second wall portion.

4. The ink cartridge attachment/detachment device according to any one of claims 1, 2 and 3, wherein the first cam portion has a chord portion and an arc portion.

* * * * *